US009129504B2

(12) United States Patent
Oliphant et al.

(10) Patent No.: US 9,129,504 B2
(45) Date of Patent: Sep. 8, 2015

(54) TRACKING DEVICE INCORPORATING CUFF WITH CUT RESISTANT MATERIALS

(71) Applicant: SECUREALERT, INC., Sandy, UT (US)

(72) Inventors: P. Christian Oliphant, West Valley, UT (US); Bruce G. Derrick, South Jordan, UT (US)

(73) Assignee: SecureAlert, Inc., Salt Lake City, UT (US)

( * ) Notice: Subject to any disclaimer, the term of this patent is extended or adjusted under 35 U.S.C. 154(b) by 0 days.

(21) Appl. No.: 14/307,260

(22) Filed: Jun. 17, 2014

(65) Prior Publication Data

US 2014/0292513 A1 Oct. 2, 2014

(51) Int. Cl.

| | |
|---|---|
| ***G08B 23/00*** | (2006.01) |
| ***G08B 21/02*** | (2006.01) |
| ***G08B 21/22*** | (2006.01) |
| ***G08B 21/00*** | (2006.01) |

(52) U.S. Cl.

CPC ..... *G08B 21/0288* (2013.01); *G08B 21/00* (2013.01); *G08B 21/0286* (2013.01); *G08B 21/22* (2013.01)

(58) Field of Classification Search

CPC ..... G08B 21/0288; G08B 21/0286; G08B 21/22; G08B 21/00

USPC ..... 340/573.1, 573.4, 539.11, 539.13, 340/693.5, 693.9

See application file for complete search history.

(56) References Cited

U.S. PATENT DOCUMENTS

| | | | |
|---|---|---|---|
| 2,986,543 | A | 5/1961 | Daniel |
| 3,210,747 | A | 10/1965 | Clynes |
| 3,440,633 | A | 4/1969 | Vinding |
| 3,462,692 | A | 8/1969 | Bartlett |
| 3,478,344 | A | 11/1969 | Schwitzgebel |
| 3,568,161 | A | 3/1971 | Knickel |
| 3,572,316 | A | 3/1971 | Vogelman |
| 3,609,741 | A | 9/1971 | Miller |
| 3,639,907 | A | 2/1972 | Greatbatch |
| 3,656,456 | A | 4/1972 | Stigmark |
| 3,665,448 | A | 5/1972 | McGlinchey |
| 3,743,865 | A | 7/1973 | Riechmann |
| 3,758,855 | A | 9/1973 | Meyer |
| 3,764,819 | A | 10/1973 | Muller |
| 3,876,890 | A | 4/1975 | Brown |
| 3,882,277 | A | 5/1975 | DePedro |
| 3,898,472 | A | 8/1975 | Long |
| 3,898,984 | A | 8/1975 | Mandel |

(Continued)

FOREIGN PATENT DOCUMENTS

| | | |
|---|---|---|
| DE | 4413974 | 11/1995 |
| DE | 19625581 | 12/1997 |

(Continued)

OTHER PUBLICATIONS

U.S. Appl. No. 09/485,080, filed Jan. 31, 2000, Boling.

(Continued)

*Primary Examiner* — Thomas Mullen

(74) *Attorney, Agent, or Firm* — Workman Nydegger

(57) ABSTRACT

A mounting strap assembly or cuff of a tracking device includes a primary mounting strap and at least one secondary reinforcing strap. Cut resistant material having the form of a woven, knitted, stranded, mesh or stacked material is also provided to further resist cutting or severing of the cuff.

20 Claims, 17 Drawing Sheets

(56) References Cited

U.S. PATENT DOCUMENTS 3,914,692 A 10/1975 Seaborn
3,925,763 A 12/1975 Wadhwani
3,930,249 A 12/1975 Steck
3,972,320 A 8/1976 Kalman
3,973,208 A 8/1976 Diamond
3,983,483 A 9/1976 Pando
4,095,214 A 6/1978 Minasy
4,110,741 A 8/1978 Hubert
4,157,540 A 6/1979 Oros
4,234,840 A 11/1980 Konrad
4,237,344 A 12/1980 Moore
4,258,709 A 3/1981 Flack
4,259,665 A 3/1981 Manning
4,275,385 A 6/1981 White
4,285,146 A 8/1981 Charles
4,293,852 A 10/1981 Rogers
4,295,132 A 10/1981 Burney
4,309,697 A 1/1982 Weaver
4,316,134 A 2/1982 Balan
4,319,241 A 3/1982 Mount
4,331,161 A 5/1982 Patel
4,342,986 A 8/1982 Buskirk
4,359,733 A 11/1982 O'Neill
4,445,118 A 4/1984 Taylor
4,446,454 A 5/1984 Pyle
4,523,184 A 6/1985 Abel
4,536,755 A 8/1985 Holzgang
4,549,169 A 10/1985 Moura
4,558,309 A 12/1985 Antonevich
4,559,526 A 12/1985 Tani
4,578,539 A 3/1986 Townsing
4,591,661 A 5/1986 Benedetto
4,596,988 A 6/1986 Wanka
4,598,272 A 7/1986 Cox
4,598,275 A 7/1986 Ross
4,622,544 A 11/1986 Bially
4,630,035 A 12/1986 Stahl
4,651,157 A 3/1987 Gray
4,665,370 A 5/1987 Holland
4,665,385 A 5/1987 Henderson
4,665,387 A 5/1987 Cooper
4,667,203 A 5/1987 Counselman
4,673,936 A 6/1987 Kotoh
4,675,656 A 6/1987 Narcisse
4,682,155 A 7/1987 Shirley
4,701,760 A 10/1987 Raoux
4,728,959 A 3/1988 Maloney
4,731,613 A 3/1988 Endo
4,736,196 A 4/1988 McMahon
4,737,976 A 4/1988 Borth
4,740,792 A 4/1988 Sagey
4,741,245 A 5/1988 Malone
4,742,336 A 5/1988 Hall
4,742,357 A 5/1988 Rackley
4,747,120 A 5/1988 Foley
4,750,197 A 6/1988 Denekamp
4,751,512 A 6/1988 Longaker
4,754,283 A 6/1988 Fowler
4,754,465 A 6/1988 Trimble
4,764,757 A 8/1988 DeMarco
4,777,477 A 10/1988 Watson
4,791,572 A 12/1988 Green
4,809,005 A 2/1989 Counselman
4,812,823 A 3/1989 Dickerson
4,812,991 A 3/1989 Hatch
4,819,053 A 4/1989 Halavais
4,819,162 A 4/1989 Webb
4,819,860 A 4/1989 Hargrove
4,820,966 A 4/1989 Fridman
4,825,457 A 4/1989 Lebowitz
4,833,477 A 5/1989 Tendler
4,837,568 A 6/1989 Snaper
4,843,377 A 6/1989 Fuller
4,864,277 A 9/1989 Goodman
4,885,571 A 12/1989 Pauley
4,888,716 A 12/1989 Ueno
4,891,650 A 1/1990 Sheffer
4,891,761 A 1/1990 Gray
4,894,662 A 1/1990 Counselman
4,897,642 A 1/1990 DiLullo
4,903,212 A 2/1990 Yokouchi
4,907,290 A 3/1990 Crompton
4,908,629 A 3/1990 Apsell
4,912,756 A 3/1990 Hop
4,916,435 A 4/1990 Fuller
4,918,425 A 4/1990 Greenberg
4,918,432 A 4/1990 Pauley
4,924,699 A 5/1990 Kuroda
4,928,107 A 5/1990 Kuroda
4,952,913 A 8/1990 Pauley
4,952,928 A 8/1990 Carroll
4,953,198 A 8/1990 Daly
4,956,861 A 9/1990 Kondo
4,961,212 A 10/1990 Marui
4,965,548 A 10/1990 Fayfield
4,980,671 A * 12/1990 McCurdy ..... 340/568.1
4,983,980 A 1/1991 Ando
4,993,061 A 2/1991 Hsieh
4,996,161 A 2/1991 Conners
4,999,613 A 3/1991 Williamson
5,003,317 A 3/1991 Gray
5,003,595 A 3/1991 Collins
5,008,930 A 4/1991 Gawrys
5,014,040 A 5/1991 Weaver
5,014,066 A 5/1991 Counselman
5,014,206 A 5/1991 Scribner
5,019,802 A 5/1991 Brittain
5,019,828 A 5/1991 Schoolman
5,021,794 A 6/1991 Lawrence
5,023,904 A 6/1991 Kaplan
5,025,253 A 6/1991 Dilullo
5,025,261 A 6/1991 Ohta
5,032,823 A 7/1991 Bower
5,032,845 A 7/1991 Velasco
5,043,736 A 8/1991 Darnell
5,055,851 A 10/1991 Sheffer
5,075,670 A 12/1991 Bower
5,077,788 A 12/1991 Cook
5,081,667 A 1/1992 Drori
5,115,223 A 5/1992 Moody
5,117,222 A 5/1992 McCurdy
5,119,102 A 6/1992 Barnard
5,131,020 A 7/1992 Liebesny
5,146,207 A 9/1992 Henry
5,146,231 A 9/1992 Ghaem
5,148,471 A 9/1992 Metroka
5,148,473 A 9/1992 Freeland
5,155,689 A 10/1992 Wortham
5,170,426 A 12/1992 D'Alessio
5,179,519 A 1/1993 Adachi
5,182,543 A 1/1993 Siegel
5,193,215 A 3/1993 Olmer
5,198,831 A 3/1993 Burrell
5,203,009 A 4/1993 Bogusz
5,204,670 A 4/1993 Stinton
5,206,897 A 4/1993 Goudreau
5,218,344 A 6/1993 Ricketts
5,218,367 A 6/1993 Sheffer
5,220,509 A 6/1993 Takemura
5,223,844 A 6/1993 Mansell
5,225,842 A 7/1993 Brown
5,235,320 A 8/1993 Romano
5,235,633 A 8/1993 Dennison
5,243,652 A 9/1993 Teare
5,247,564 A 9/1993 Zicker
5,255,183 A 10/1993 Katz
5,255,306 A 10/1993 Melton
5,257,195 A 10/1993 Hirata
5,266,944 A 11/1993 Carroll
5,266,958 A 11/1993 Durboraw
5,268,845 A 12/1993 Startup
5,274,695 A 12/1993 Green
5,278,539 A 1/1994 Lauterbach
5,297,186 A 3/1994 Dong

(56) References Cited

U.S. PATENT DOCUMENTS 5,298,884 A 3/1994 Gilmore
5,299,132 A 3/1994 Wortham
5,305,370 A 4/1994 Kearns
5,307,277 A 4/1994 Hirano
5,311,197 A 5/1994 Sorden
5,311,374 A 5/1994 Oh
5,317,309 A 5/1994 Vercellotti
5,317,620 A 5/1994 Smith
5,319,374 A 6/1994 Desai
5,319,698 A 6/1994 Glidewell
5,334,974 A 8/1994 Simms
5,334,986 A 8/1994 Fernhout
5,349,530 A 9/1994 Odagawa
5,353,376 A 10/1994 Oh
5,355,140 A 10/1994 Slavin
5,357,560 A 10/1994 Nykerk
5,365,451 A 11/1994 Wang
5,365,570 A 11/1994 Boubelik
5,367,524 A 11/1994 Rideout
5,369,699 A 11/1994 Page
5,374,933 A 12/1994 Kao
5,377,256 A 12/1994 Franklin
5,379,224 A 1/1995 Brown
5,388,147 A 2/1995 Grimes
5,389,934 A 2/1995 Kass
5,392,052 A 2/1995 Eberwine
5,394,333 A 2/1995 Kao
5,396,227 A 3/1995 Carroll
5,396,516 A 3/1995 Padovani
5,396,540 A 3/1995 Gooch
5,398,190 A 3/1995 Wortham
5,402,466 A 3/1995 Delahanty
5,416,468 A 5/1995 Baumann
5,416,695 A 5/1995 Stutman
5,416,808 A 5/1995 Witsaman
5,418,537 A 5/1995 Bird
5,422,816 A 6/1995 Sprague
5,426,425 A 6/1995 Conrad
5,428,546 A 6/1995 Shah
5,430,656 A 7/1995 Dekel
5,437,278 A 8/1995 Wilk
5,438,315 A 8/1995 Nix
5,444,430 A 8/1995 Mcshane
5,448,221 A 9/1995 Weller
5,451,948 A 9/1995 Jekel
5,461,365 A 10/1995 Schlager
5,461,390 A 10/1995 Hoshen
5,465,388 A 11/1995 Zicker
5,475,751 A 12/1995 McMonagle
5,479,149 A 12/1995 Pike
5,479,479 A 12/1995 Braitberg
5,479,482 A 12/1995 Grimes
5,485,385 A 1/1996 Mitsugi
5,490,200 A 2/1996 Snyder
5,493,692 A 2/1996 Theimer
5,493,694 A 2/1996 Vicek
5,497,148 A 3/1996 Oliva
5,497,149 A 3/1996 Fast
5,504,482 A 4/1996 Schreder
5,510,797 A 4/1996 Abraham
5,512,879 A 4/1996 Stokes
5,513,111 A 4/1996 Wortham
5,515,043 A 5/1996 Bernard
5,515,062 A 5/1996 Maine
5,515,285 A 5/1996 Garrett
5,517,419 A 5/1996 Lanckton
5,518,402 A 5/1996 Tommarello
5,519,380 A 5/1996 Edwards
5,519,403 A 5/1996 Bickley
5,519,621 A 5/1996 Wortham
5,523,740 A 6/1996 Burgmann
5,525,967 A 6/1996 Azizi
5,525,969 A 6/1996 LaDue
5,528,248 A 6/1996 Steiner
5,532,690 A 7/1996 Hertel
5,537,102 A 7/1996 Pinnow
5,541,845 A 7/1996 Klein
5,542,100 A 7/1996 Hatakeyama
5,543,780 A 8/1996 McAuley
5,544,661 A 8/1996 Davis
5,546,445 A 8/1996 Dennison
5,550,551 A 8/1996 Alesio
5,552,772 A 9/1996 Janky
5,555,286 A 9/1996 Tendler
5,557,254 A 9/1996 Johnson
5,559,491 A 9/1996 Stadler
5,559,497 A 9/1996 Hong
5,563,931 A 10/1996 Bishop
5,568,119 A 10/1996 Schnipper
5,572,204 A 11/1996 Timm
5,572,217 A 11/1996 Flawn
5,574,649 A 11/1996 Levy
5,576,716 A 11/1996 Sadler
5,587,715 A 12/1996 Lewis
5,588,038 A 12/1996 Snyder
5,589,834 A 12/1996 Weinberg
5,594,425 A 1/1997 Ladner
5,594,650 A 1/1997 Shah
5,596,262 A 1/1997 Boll
5,596,313 A 1/1997 Berglund
5,598,151 A 1/1997 Torii
5,600,230 A 2/1997 Dunstan
5,602,739 A 2/1997 Haagenstad
5,612,675 A 3/1997 Jennings
5,617,317 A 4/1997 Ignagni
5,621,388 A 4/1997 Sherburne
5,625,668 A 4/1997 Loomis
5,627,520 A 5/1997 Grubbs
5,627,548 A 5/1997 Woo
5,629,693 A 5/1997 Janky
5,630,206 A 5/1997 Urban
5,644,317 A 7/1997 Weston
5,646,593 A 7/1997 Hughes
5,650,770 A 7/1997 Schlager
5,652,570 A 7/1997 Lepkofker
5,673,035 A 9/1997 Huang
5,673,305 A 9/1997 Ross
5,677,521 A 10/1997 Garrou
5,682,133 A 10/1997 Johnson
5,682,142 A 10/1997 Loosmore
5,684,828 A 11/1997 Bolan
5,686,910 A 11/1997 Timm
5,686,924 A 11/1997 Trimble
5,687,215 A 11/1997 Timm
5,694,452 A 12/1997 Bertolet
5,699,256 A 12/1997 Shibuya
5,703,598 A 12/1997 Emmons
5,705,980 A 1/1998 Shapiro
5,712,619 A 1/1998 Simkin
5,715,277 A 2/1998 Goodson
5,721,678 A 2/1998 Widl
5,722,081 A 2/1998 Tamura
5,722,418 A 3/1998 Bro
5,724,316 A 3/1998 Brunts
5,726,893 A 3/1998 Schuchman
5,727,057 A 3/1998 Emery
5,731,757 A * 3/1998 Layson, Jr. ..... 340/573.1
5,732,076 A 3/1998 Ketseoglou
5,736,962 A 4/1998 Tendler
5,740,049 A 4/1998 Kaise
5,740,532 A 4/1998 Fernandez
5,740,547 A 4/1998 Kull
5,742,233 A 4/1998 Hoffman
5,742,509 A 4/1998 Goldberg
5,742,666 A 4/1998 Alpert
5,742,686 A 4/1998 Finley
5,742,904 A 4/1998 Pinder
5,745,037 A 4/1998 Guthrie
5,745,849 A 4/1998 Britton
5,745,868 A 4/1998 Geier
5,748,089 A 5/1998 Sizemore
5,748,148 A 5/1998 Heiser
5,751,246 A 5/1998 Hertel
5,752,976 A 5/1998 Duffin

(56) References Cited

U.S. PATENT DOCUMENTS 5,757,367 A 5/1998 Kapoor
5,760,692 A 6/1998 Block
5,767,788 A 6/1998 Ness
5,771,002 A 6/1998 Creek
5,774,825 A 6/1998 Reynolds
5,777,580 A 7/1998 Janky
5,781,101 A 7/1998 Stephen
5,784,029 A 7/1998 Geier
5,786,789 A 7/1998 Janky
5,790,022 A 8/1998 Delvecchio
5,790,974 A 8/1998 Tognazzini
5,793,283 A 8/1998 Davis
5,793,630 A 8/1998 Theimer
5,794,174 A 8/1998 Janky
5,796,613 A 8/1998 Kato
5,796,777 A 8/1998 Terlep
5,797,091 A 8/1998 Clise
5,805,055 A 9/1998 Colizza
5,809,426 A 9/1998 Radojevic
5,809,520 A 9/1998 Edwards
5,811,886 A 9/1998 Majmudar
5,815,118 A 9/1998 Schipper
5,818,333 A 10/1998 Yaffe
5,819,864 A 10/1998 Koike
5,825,283 A 10/1998 Camhi
5,825,327 A 10/1998 Krasner
5,825,871 A 10/1998 Mark
5,828,292 A 10/1998 Kokhan
5,831,535 A 11/1998 Reisman
5,835,017 A 11/1998 Ohkura
5,835,907 A 11/1998 Newman
5,842,146 A 11/1998 Shishido
5,844,894 A 12/1998 Dent
5,847,679 A 12/1998 Yee
5,852,401 A 12/1998 Kita
5,857,433 A 1/1999 Files
5,867,103 A 2/1999 Taylor
5,868,100 A 2/1999 Marsh
5,873,040 A 2/1999 Dunn
5,874,801 A 2/1999 Kobayashi
5,874,889 A 2/1999 Higdon
5,875,402 A 2/1999 Yamawaki
5,877,724 A 3/1999 Davis
5,889,474 A 3/1999 LaDue
5,890,061 A 3/1999 Timm
5,890,092 A 3/1999 Kato
5,892,447 A 4/1999 Wilkinson
5,892,454 A 4/1999 Schipper
5,892,825 A 4/1999 Mages
5,894,498 A 4/1999 Kotzin
5,898,391 A 4/1999 Jefferies
5,900,734 A 5/1999 Munson
5,905,461 A 5/1999 Neher
5,906,655 A 5/1999 Fan
5,907,555 A 5/1999 Raith
5,912,623 A 6/1999 Pierson
5,912,886 A 6/1999 Takahashi
5,912,921 A 6/1999 Warren
5,914,675 A 6/1999 Tognazzini
5,917,405 A 6/1999 Joao
5,918,180 A 6/1999 Dimino
5,918,183 A 6/1999 Janky
5,919,239 A 7/1999 Fraker
5,920,278 A 7/1999 Tyler
5,926,086 A 7/1999 Escareno
5,928,306 A 7/1999 France
5,929,752 A 7/1999 Janky
5,929,753 A 7/1999 Montague
5,933,080 A 8/1999 Nojima
5,936,529 A 8/1999 Reisman
5,936,530 A 8/1999 Meinhold
5,937,164 A 8/1999 Mages
5,940,004 A 8/1999 Fulton
5,940,439 A 8/1999 Kleider
5,945,906 A 8/1999 Onuma
5,945,944 A 8/1999 Krasner
5,948,043 A 9/1999 Mathis
5,949,350 A 9/1999 Girard
5,959,533 A 9/1999 Layson
5,963,130 A 10/1999 Schlager
5,966,079 A 10/1999 Tanguay
5,969,600 A 10/1999 Tanguay
5,969,673 A 10/1999 Bickley
5,982,281 A 11/1999 Layson
5,982,813 A 11/1999 Dutta
5,983,115 A 11/1999 Mizikovsky
5,990,785 A 11/1999 Suda
5,990,793 A 11/1999 Bieback
5,991,637 A 11/1999 Mack
5,995,847 A 11/1999 Gergen
5,997,476 A 12/1999 Brown
5,999,124 A 12/1999 Sheynblat
6,009,363 A 12/1999 Beckert
6,011,510 A 1/2000 Yee
6,014,080 A * 1/2000 Layson, Jr. ..... 340/573.1
6,014,555 A 1/2000 Tendler
6,018,667 A 1/2000 Ghosh
6,025,774 A 2/2000 Forbes
6,025,779 A 2/2000 Huang
6,026,125 A 2/2000 Larrick
6,026,300 A 2/2000 Hicks
6,026,345 A 2/2000 Shah
6,028,551 A 2/2000 Schoen
6,029,111 A 2/2000 Croyle
6,031,454 A 2/2000 Lovejoy
6,031,460 A 2/2000 Banks
6,034,622 A 3/2000 Levine
6,035,201 A 3/2000 Whitehead
6,035,217 A 3/2000 Kravitz
6,044,257 A 3/2000 Boling
6,046,687 A 4/2000 Janky
6,047,196 A 4/2000 Makela
6,054,928 A 4/2000 Lemelson
6,055,426 A 4/2000 Beasley
6,060,982 A 5/2000 Holtrop
6,061,018 A 5/2000 Sheynblat
6,061,392 A 5/2000 Bremer
6,061,561 A 5/2000 Alanara
6,069,570 A 5/2000 Herring
6,072,396 A 6/2000 Gaukel
6,075,797 A 6/2000 Thomas
6,075,821 A 6/2000 Kao
6,084,510 A 7/2000 Lemelson
6,084,906 A 7/2000 Kao
6,084,917 A 7/2000 Kao
6,088,387 A 7/2000 Gelblum
6,088,586 A 7/2000 Haverty
6,091,325 A 7/2000 Zur
6,091,786 A 7/2000 Chen
6,091,957 A 7/2000 Larkins
6,094,140 A 7/2000 Parente
6,097,337 A 8/2000 Bisio
6,100,806 A 8/2000 Gaukel
6,115,597 A 9/2000 Kroll
6,130,620 A 10/2000 Pinnow
6,160,481 A 12/2000 Taylor
6,181,253 B1 1/2001 Eschenbach
6,198,394 B1 3/2001 Jacobsen
6,198,914 B1 3/2001 Saegusa
6,218,945 B1 4/2001 Taylor
6,226,510 B1 5/2001 Boling
6,232,916 B1 5/2001 Grillo
6,236,319 B1 5/2001 Pitzer
6,239,700 B1 5/2001 Hoffman
6,262,666 B1 7/2001 Lodichand
6,285,867 B1 9/2001 Boling
6,313,733 B1 11/2001 Kyte
6,356,841 B1 3/2002 Hamrick
6,362,778 B2 3/2002 Neher
6,405,213 B1 6/2002 Layson
6,437,696 B1 8/2002 Lemelson
6,518,889 B2 2/2003 Schlager
6,580,908 B1 6/2003 Kroll
6,636,732 B1 10/2003 Boling

(56) References Cited

U.S. PATENT DOCUMENTS

| | | | | |
|---|---|---|---|---|
| 6,639,516 | B1 | 10/2003 | Copley | |
| 6,639,519 | B2 | 10/2003 | Drummond | |
| 6,646,617 | B1 | 11/2003 | Gaukel | |
| 6,671,351 | B2 | 12/2003 | Menard | |
| 6,674,368 | B2 | 1/2004 | Hawkins | |
| 6,675,006 | B1 | 1/2004 | Diaz | |
| 6,687,497 | B1 | 2/2004 | Parvulescu | |
| 6,703,936 | B2 | 3/2004 | Hill | |
| 6,762,684 | B1 | 7/2004 | Camhi | |
| 6,765,991 | B1 | 7/2004 | Hanuschak | |
| 6,766,159 | B2 | 7/2004 | Lindholm | |
| 6,774,797 | B2 | 8/2004 | Freathy | |
| 6,782,208 | B1 | 8/2004 | Lundholm | |
| 6,847,892 | B2 | 1/2005 | Zhou | |
| 6,859,650 | B1 | 2/2005 | Ritter | |
| 6,912,399 | B2 | 6/2005 | Zirul | |
| RE38,838 | E | 10/2005 | Taylor | |
| 6,972,684 | B2 | 12/2005 | Copley | |
| 6,992,582 | B2 | 1/2006 | Hill et al. | |
| 7,002,477 | B1 | 2/2006 | Camhi | |
| 7,015,817 | B2 | 3/2006 | Copley | |
| 7,026,929 | B1 | 4/2006 | Wallace | |
| 7,038,590 | B2 | 5/2006 | Hoffman | |
| 7,042,338 | B1 | 5/2006 | Weber | |
| 7,061,399 | B2 | 6/2006 | Leck | |
| 7,092,695 | B1 | 8/2006 | Boling | |
| 7,106,191 | B1 | 9/2006 | Liberati | |
| 7,119,690 | B2 | 10/2006 | Lerch et al. | |
| 7,123,141 | B2 | 10/2006 | Contestabile | |
| 7,251,471 | B2 | 7/2007 | Boling | |
| 7,289,031 | B1 | 10/2007 | Hock | |
| RE39,909 | E | 11/2007 | Taylor | |
| 7,330,122 | B2 * | 2/2008 | Derrick et al. | 340/573.1 |
| 7,446,656 | B2 | 11/2008 | Blakeway | |
| 7,545,318 | B2 | 6/2009 | Derrick | |
| 7,737,841 | B2 | 6/2010 | Derrick | |
| 2002/0084904 | A1 | 7/2002 | De La Huerga | |
| 2002/0115436 | A1 | 8/2002 | Howell | |
| 2003/0027547 | A1 | 2/2003 | Wade | |
| 2003/0107487 | A1 | 6/2003 | Korman | |
| 2003/0197612 | A1 | 10/2003 | Tanaka | |
| 2005/0193104 | A1 | 9/2005 | Mason | |
| 2006/0047543 | A1 | 3/2006 | Moses | |
| 2007/0023496 | A1 | 2/2007 | Hall | |
| 2007/0041427 | A1 | 2/2007 | Small | |
| 2007/0082677 | A1 | 4/2007 | Hart | |
| 2007/0258417 | A1 | 11/2007 | Harvey | |
| 2008/0012760 | A1 | 1/2008 | Derrick | |
| 2008/0018458 | A1 | 1/2008 | Derrick | |
| 2008/0096521 | A1 | 4/2008 | Boling | |
| 2008/0174422 | A1 | 7/2008 | Freathy | |
| 2008/0218358 | A1 | 9/2008 | Derrick | |
| 2008/0316022 | A1 | 12/2008 | Buck | |
| 2009/0174550 | A1 | 7/2009 | Aninye et al. | |
| 2009/0224909 | A1 | 9/2009 | Derrick | |
| 2010/0052916 | A1 | 3/2010 | Canora et al. | |
| 2010/0238024 | A1 | 9/2010 | Derrick | |
| 2010/0328063 | A1 | 12/2010 | Derrick | |
| 2011/0248853 | A1 | 10/2011 | Roper | |
| 2013/0328680 | A1 | 12/2013 | Roper | |
| 2014/0002575 | A1 * | 1/2014 | Fennell | 348/14.02 |
| 2014/0292513 | A1 | 10/2014 | Oliphant | |

FOREIGN PATENT DOCUMENTS

| | | | |
|---|---|---|---|
| EP | 0017448 | | 10/1980 |
| EP | 0242099 | A2 | 10/1987 |
| EP | 0489915 | A1 | 6/1992 |
| EP | 496538 | A2 | 7/1992 |
| EP | 745867 | A1 | 12/1996 |
| EP | 0780993 | | 6/1997 |
| EP | 0809117 | | 11/1997 |
| EP | 0889631 | | 1/1999 |
| EP | 0946037 | | 9/1999 |
| EP | 1363258 | | 11/2003 |
| GB | 2141006 | | 12/1984 |
| JP | 2007200 | A | 1/1990 |
| JP | 6020191 | A | 1/1994 |
| JP | 6036185 | A | 2/1994 |
| WO | WO 87-04851 | | 8/1987 |
| WO | WO 87-06713 | | 11/1987 |
| WO | WO 93/00663 | | 1/1993 |
| WO | WO 97-03511 | | 1/1997 |
| WO | WO 00-77688 | | 12/2000 |
| WO | WO 01/73466 | | 10/2001 |

OTHER PUBLICATIONS

John H Murphy et al., "Advanced Electronic Monitoring for Tracking Persons on Probation or Parole: Final Report", Grumman STC, Feb. 1996.

D. Evans, "Electronic Monitoring: Testimony to Ontario's Standing Committee on Administration of Justice", Perspectives, Fall 1996, pp. 8-10.

Albert et al., "GIS/GPS in Law Enforcement Master Bibliography", Nov. 2000.

M. Anderson (Editor), "GPS Used to Track Criminals", GIS World, Aug. 1996, p. 15.

B. Clede, "Radio Computers Locate Places, and Plot Them on a Map, Too", Law and Order, Oct. 1994, <http://www.clede.com/Articles/Police/gps.htm>.

D. Anderson et al., "Seattle and Tacoma PDs Automated Crime Analysis", The Journal, National FOP Journal, Spring 1990.

B. Wise, "Catching Crooks with Computers", American City and Country, May 1995, pp. 54-62.

M. Alexander et al., "An Automated System for the Identification and Prioritization of Rape Suspects", SDSS for Rape Suspect Identification, http://www.esri.com/library/userconf/proc97/proc97/to350/pap333.htm, Jul. 2001.

L. Pilant, "Spotlight on . . . High-Technology Solutions", From Police Chief, Document #54650, May 1996.

M. Lyew, "A New Weapon for Fighting Crime", American Probation and Parole Association, "Electronic Monitoring", 1996, <http://www.appa-net.org/about%20appa/electron.htm.

Hoshen, J.; Sennott, J.; Winkler, M. "Keeping tabs on criminals [electronic monitoring]" Spectrum, IEEE, vol. 32, Issue 2, Feb. 1995, pp. 26-32.

National Center for Juvenile Justice. (1991). Desktop guide to good juvenile probation practice, Pittsburgh, PA: Author.

Davis, S. (1986). Evaluation of the First Year of Expanded House Arrest, Oct. 1, 1984-Sep. 30, 1985: Oklahoma Department of Corrections.

Jones, R K., Wiliszowski, C. H., & Lacey, J. H. (1996). Evaluation of Alternative Programs for Repeat DWI Offenders (Report prepared by Mid-America Research Institute No. DOT HS 808 493). Washington, D.C.: National Highway Traffic Safety Administration Office of Program Development and Evaluation.

Nieto, M. (1996). Community correction Punishments: An Alternative to Incarceration for Nonviolent Offenders, Sacramento, California Research Bureau.

Reconnecting Youth & Community: A Youth Development Approach. (1996). Washington, DC: Family and Youth Services Bureau, Administration on Children, Youth and Families, U.S. Department of Health and Human Services.

Whitfield, D. Tackling the Tag: The Electronic Monitoring of Offenders. Winchester, U.K.: Waterside Press, 1997. (Books).

Torbet, P. M. (1997). Automated information systems in juvenile probation. In D. W. Thomas & P. M. Torbet (Eds.), Juvenile probation administrator's desktop guide (pp. 81-89). Pittsburgh, PA: National Center for Juvenile Justice.

Spaans, E. C., & Verwers, C. (1997), Electronic monitoring in the Netherlands: results of the experiment. The Hague, Netherlands: Ministry of Justice.

Church, A., & Dunstan, S. (1997). Home Detention: the Evaluation of the Home Detention Pilot Program 1995-1997. Wellington, New Zealand: Ministry of Justice.

(56) References Cited

OTHER PUBLICATIONS

Canada. Solicitor General Canada. Annual Report on the Use of Electronic Surveillance as Required Under Subsection 195(1) of the Criminal Code. Ottawa: Solicitor General Canada, 1991-1994. (Book).
Schwitzgebel, R. L., & Bird, R. M. (1970). Sociotechnical design factors in remote instrumentation with humans in natural environments. Behavior Research Methods and Instrumentation, 2(3),99-105.
Gould, L. A., & Archambault, W. G. (1995). Evaluation of a Computer-Assisted Monitoring (CAMO) Project: Some Measurement Issues. American Journal of Criminal Justice, 19(2), 255-273.
Gable, R. K. (1986). Application of personal telemonitoring to current problems in corrections. Journal of Criminal Justice, 14 (2),167-176.
Mainprize, S. (1996). Elective Affinities in the Engineering of Social Control: The Evolution of Electronic Monitoring. Electronic Journal of Sociology, 2(2), 26.
Charles, Michael T. "The Development of a Juvenile Electronic Monitoring Program." Federal Probation, vol. 53 (1989), 3-12.
Huskey, B. L. (1987). Electronic Monitoring: an Evolving Alternative, Perspectives, 11(3), 19-23.
G.W. Brown Jr., "What Impact Will Personal Position Location Technology Have Upon the Management and Administration of Mid-Sized Law Enforcement Organizations by the Year 2000?", California Commission of Peace Officer Standards and Training, Sacramento, California, Jul. 1994.
U.S. Appl. No. 12/028,088, May 13, 2009, Office Action.
U.S. Appl. No. 11/486,992, Jun. 9, 2008, Office Action.
U.S. Appl. No. 11/486,992, Jan. 22, 2009, Office Action.
U.S. Appl. No. 11/486,989, Feb. 4, 2008, Office Action.
U.S. Appl. No. 11/486,989, Jan. 26, 2009, Office Action.
U.S. Appl. No. 11/486,976, May 22, 2008, Office Action.
U.S. Appl. No. 11/486,976, Oct. 2, 2008, Office Action.
U.S. Appl. No. 11/486,976, Jan. 28, 2009, Office Action.
U.S. Appl. No. 11/486,976, Jul. 20, 2009, Office Action.
U.S. Appl. No. 11/486,991, Dec. 12, 2007, Office Action.
U.S. Appl. No. 11/486,991, Jul. 7, 2008, Office Action.
U.S. Appl. No. 11/486,991, Feb. 27, 2009, Notice of Allowance.
U.S. Appl. No. 11/486,398, Dec. 11, 2008, Office Action.
U.S. Appl. No. 11/830,398, Aug. 19, 2009, Office Action.
U.S. Appl. No. 11/486,992, Sep. 18, 2009, Notice of Allowance.
U.S. Appl. No. 11/486,992, Dec. 29, 2009, Notice of Allowance.
U.S. Appl. No. 11/486,976, Dec. 21, 2009, Office Action.
U.S. Appl. No. 12/028,008, Jan. 11, 2010, Office Action.
U.S. Appl. No. 11/486,989, Feb. 23, 2010, Office Action.
U.S. Appl. No. 12/028,088, Apr. 16, 2010, Notice of Allowance.
U.S. Appl. No. 11/486,989, Jul. 28, 2010, Office Action.
U.S. Appl. No. 12/792,572, Oct. 6, 2010, Office Action.
U.S. Appl. No. 11/486,976, Oct. 28, 2010, Notice of Allowance.
U.S. Appl. No. 12/875,988, Nov. 16, 2010, Office Action.
U.S. Appl. No. 11/486,989, Dec. 21, 2010, Office Action.
U.S. Appl. No. 11/486,976, Jan. 6, 2011, Notice of Allowance.
U.S. Appl. No. 12/792,572, Mar. 3, 2011, Notice of Allowance.
U.S. Appl. No. 12/875,988, Jun. 10, 2011, Notice of Allowance.
U.S. Appl. No. 11/486,989, May 24, 2011, Office Action.
U.S. Appl. No. 11/486,989, Dec. 13, 2011, Office Action.
U.S. Appl. No. 12/399,151, Dec. 30, 2011, Office Action.
U.S. Appl. No. 13/970,007, Dec. 17, 2013, Office Action.
U.S. Appl. No. 12/818,453, Nov. 15, 2012, Office Action.
U.S. Appl. No. 12/818,453, Apr. 18, 2013, Notice of Allowance.
U.S. Appl. No. 11/486,989, Jul. 29, 2008, Office Action.

* cited by examiner

TRACKING DEVICE INCORPORATING CUFF WITH CUT RESISTANT MATERIALS

CROSS-REFERENCE TO RELATED APPLICATIONS

N/A.

BACKGROUND OF THE INVENTION

1. The Field of the Invention

The present invention generally relates to tracking devices and corresponding communication systems and methods of use and, even more particularly, to tracking devices having enhanced security mounting strap configurations and corresponding systems and methods of use.

2. The Relevant Technology

Criminal offenders who have been granted parole, or accused offenders awaiting trial and disposition, are often granted the ability to remain outside conventional incarceration facilities with the use of current monitoring and tracking technologies. These technologies include the NAVSTAR Global Positioning System ("GPS") for position determination and cellular and other wireless communication technologies for communicating position and status information to monitoring centers and appropriate authorities. A tracking device that is attached to an individual for the purpose of monitoring and tracking the individual is often referred to as an offender tracking device ("OTD") or a remote tracking device ("RTD").

A problem with current tracking devices is that the mounting strap that is used to secure the tracking device to an individual being monitored can often be broken or cut, sometimes with only common scissors, and quickly removed. Once removed, the individual to which the device was affixed can quickly leave the area and escape monitoring and the tracking system altogether.

While the complete severing of a mounting strap and the removal of an existing tracking device can often generate an alarm, the speed at which existing straps can be cut is such that the offender will typically have ample time to flee the location where the tracking device was removed before enforcement authorities can be summoned to that location. In the past, this has resulted in successful escapes by tracked individuals defeating such systems and, therefore, poses a real danger to the public.

In view of the importance of providing reliable tracking and monitoring of offenders and other persons of interest, any improvements in the design and integrity of the tracking devices, and monitoring systems in general, is desirable.

BRIEF SUMMARY OF THE INVENTION

The tracking devices of the present invention are provided with enhanced security characteristics comprising an assembly of straps and cut resistant materials.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of embodiments of the present invention, a more particular description of embodiments of the present invention will be rendered by reference to the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
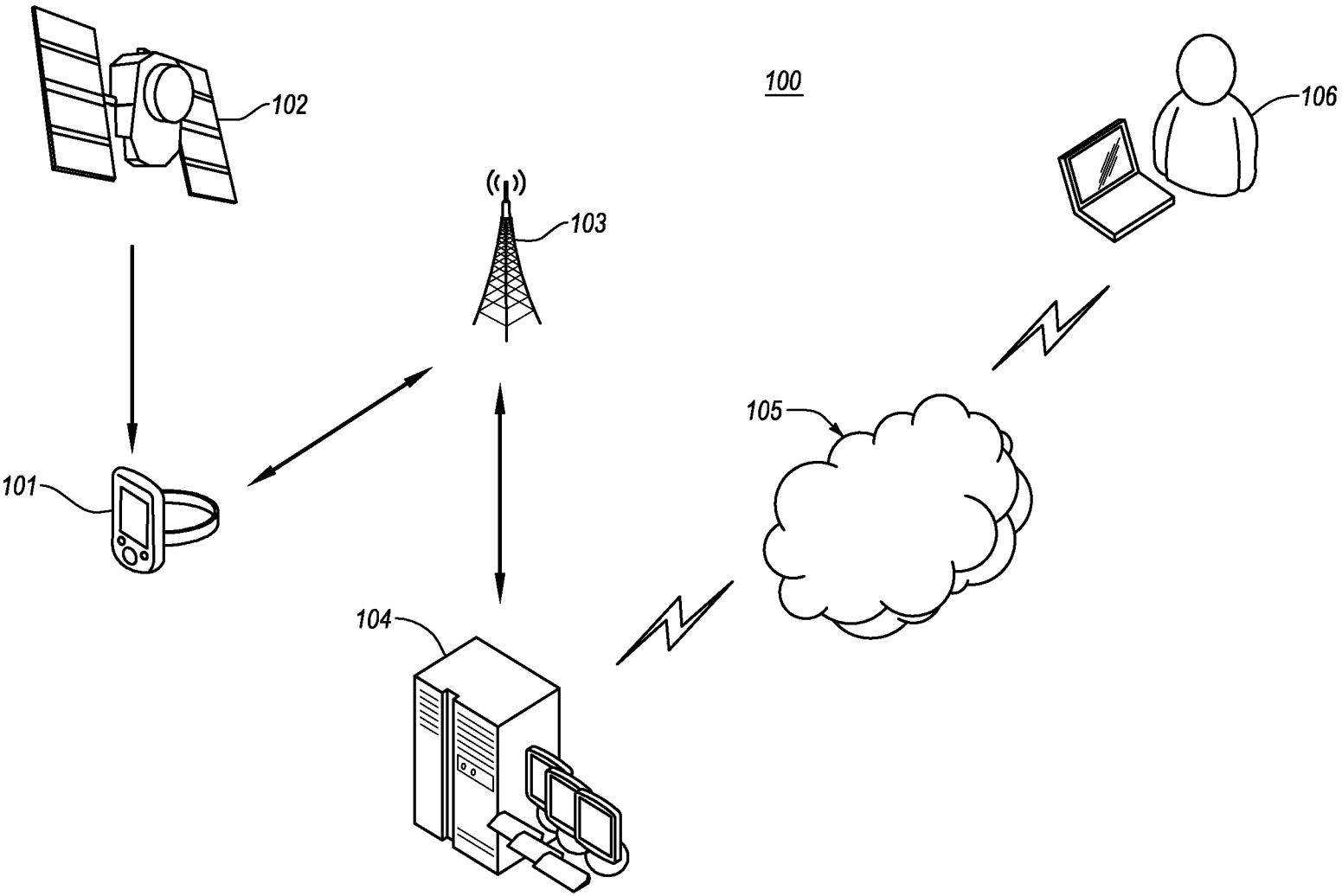
FIG. 1 illustrates a diagram of various elements of a remote tracking system.

The present invention will now be described with respect to exemplary embodiments in a specific context, namely, an offender tracking device having enhanced security features. It will be appreciated, however, that the principles of the present invention are applicable to many fields beyond offender tracking devices including, without limitation, general prisoner management, the medical environment, personal monitoring, animal tracking, and the defense industry.

Various terms that are used throughout this document will now be defined to help provide clarity to the described and claimed embodiments.

Initially, the term "tracking device", which is sometimes referred to herein as a "remote tracking device" or "offender tracking device" should not be limited by use to exclude devices that are not worn by offenders or parolees. Instead, the tracking devices described in this application should be broadly construed to apply to any tracking or monitoring device, including tracking devices that can be carried, worn or used by animals, objects (e.g., motorized vehicles, bicycles, computing equipment, containers and other devices) and persons who may or may not be considered offenders or parolees.

The term "detecting means", as used herein, refers to any electronic circuitry and corresponding software that can be used for detecting a location and status of the tracking device. According to some embodiments, the term "detecting means" refers to the internal GPS receivers and antennas, cellular transceivers used to perform tower triangulation, internal processors, system memory, and software stored in the system memory that is executed by the internal processors.

The term "communication means", as used herein, generally refers to any electronic circuitry and corresponding software that can be used to enable a tracking device to wirelessly communicate with a remote location, such as, for example, by transmitting location and status information and for receiving data from a monitoring center, as well as for enabling voice communications with one or more parties. According to some embodiments, the term "communication means" refers to short range wireless transceivers, voice-capable peripherals, cellular antennas and cellular transceivers, internal processors, system memory, and software stored in the system memory that is executed by the internal processors.

The term "mounting means" as used herein, generally refers to any physical structure that can be used to mount the disclosed tracking device(s) to an individual or object. According to some embodiments, the term "mounting means" refers to a strap, cable, band, cuff or other structure that is capable of being secured to a person or object, as well as the elements that are used to secure the strap, cable, band or other structure to the person or object, such as a latch, screw, adhesive or other mechanical or chemical bonding agent, as described in more detail below. In some embodiments, the mounting means include a mounting strap assembly that includes layers of components that are affixed to the tracking device with mounting elements, such as screws, rivets and/or anchors to a desired person or object. As described below in more detail, some of the components in the mounting strap or cuff include loose fibers that are positioned and configured to float or slide within the cuff so that they slide back and forth with a cutting blade that is moved against the cuff, making it more difficult to cut the loose fibers and other components below the fibers.

The term "tamper detection means", as used herein, generally refers to any electronic circuitry and corresponding software, as well as any physical objects that can be used to enable the detection of one or more conditions that evince tampering of the mounting strap or other component of the tracking device and for responsively triggering an alarm to the one or more conditions that evince the tampering. According to some embodiments, the tamper detection means include optical and/or electrical transceivers, optical fibers, continuity wires, signal processors and software modules that are capable of detecting signal continuity and discontinuity, as well as software modules that define alarm conditions and rules for generating corresponding alarms and related tactile notifications, which are emitted by speakers and haptic feedback devices, and the communication means for communicating the alarm data.

The term "reinforcing means" as used herein, generally refers to any physical structure that can be used to reinforce the mounting means, defined above, and for generally reinforcing the mounting of the tracking device(s) to an entity or object. According to some embodiments, the term "reinforcing means" refers to a cut resistant and hardened plastic or metal strap, cable, sheath, covering, a cut resistant fabric, or other cut resistant material which is positioned alongside, outside or inside the primary mounting strap, as described in more detail below.

Network/Tracking Device

To further aid in an understanding of the embodiments described above, some exemplary embodiments of the tracking device and corresponding internal and network components will now be described in more detail with reference to FIGS. 1-3.

FIG. 1 illustrates, a simplified diagram showing elements of a tracking system network. System 100 is used to track multiple tracking devices. Each tracking device 101 includes a positioning system engine, such as a global positioning system (GPS) engine, which is able to receive signals from one or more sources, either terrestrial networks or satellite networks such as multiple GPS satellites 102, and to perform a location calculation based on the signals from the sources. While preferred embodiments described herein will use references to GPS, any position system engine or transceiver, terrestrial, airborne or satellite based, may be used in place of GPS according to the scope of the concepts described herein, including the Galeleo, GLONASS, COMPASS or other satellite tracking system. Applicant intends the use of GPS herein to be generic to any positioning system and to include all positioning systems. Location determination using terrestrial networks, satellite, or assisted satellite (using satellite signals in association with terrestrial signals such as cellular signals to provide a more precise location determination), is well known and will not be discussed further herein.

In addition to a GPS engine, the tracking device 101 includes a wireless/cellular transceiver. After a location determination has been made by the GPS engine or an internal microprocessor, the location information and information indicating the status of the tracking device is sent over a terrestrial network, which is preferably a cellular network, as shown by cellular network 103. It will be appreciated, however, that other networks can also be used, such as, but not limited to, WiMax and WIFI networks. In order to be useful, each position location for the tracking device needs to include an indication of the time for the location. In a preferred embodiment, the tracking device uses the time information contained in the GPS signals themselves to provide the time indication for the position determination, however, instead of using the time information from the GPS signal, the tracking device itself may provide the time indication from an internal clock. An internal clock may also be used to provide time indications on when data packets were created and sent using the cellular connection.

The information sent by the tracking device 101 over its cellular connection is received by monitoring center 104. Monitoring center 104 is preferably a staffed monitoring center providing representatives who can act as an intermediary between the person or object being monitored and the parole officer, supervisor or administrator with responsibility for the entity being monitored. The monitoring center 104 also includes the computer resources required to process, store and analyze the data received from the tracking device (s) and provide the interface for the officers/supervisors/administrators to review the information in the system and to setup, modify and terminate the operating parameters for each individual tracking device. While the present embodiment is described in terms of a 'monitoring center', it will be appreciated that the invention also contemplates the use of data centers in place of monitoring centers. Data centers typically have a smaller human staff than some traditional monitoring centers and utilize sophisticated automated computer equipment in place of some human operators.

Access to the information in the monitoring center or data center is available through a web interface which connects to a network 105, such as the Internet, which allows persons with authorization 106 outside the monitoring center to access information in the monitoring center's computers. Additionally, cellular network 103 can also be used to establish two-way voice communication between the tracking device(s) and the monitoring center, or responsible officer/supervisor/administrator. While reference is made to two-way voice communication, the term two-way is meant to encompass any interactive voice communication involving two or more parties, including three or more-way voice communication and would include conference type calls and multiparty calls. The two-way voice communications may use the same infrastructure as the data connections between the tracking device and monitoring center, or may use a completely different infrastructure or alternative paths through the network than the data connections. Other third parties may also be in the voice or data path between the tracking device and monitoring center to provide any number of functions, including the recording and archival of the voice communications between the tracking device and monitoring center, and still be within the scope of the concepts described herein. As described herein, voice communications can also be rendered in the form of pre-recorded messages sent from the monitoring/data center, which are recorded as voice messages prior to being sent or that are, alternatively, entered as text at the monitoring/data center or administrator computer and then subsequently translated from text to speech at the sending computing system, at the tracking device or any intermediary communication device.

Figure 2:
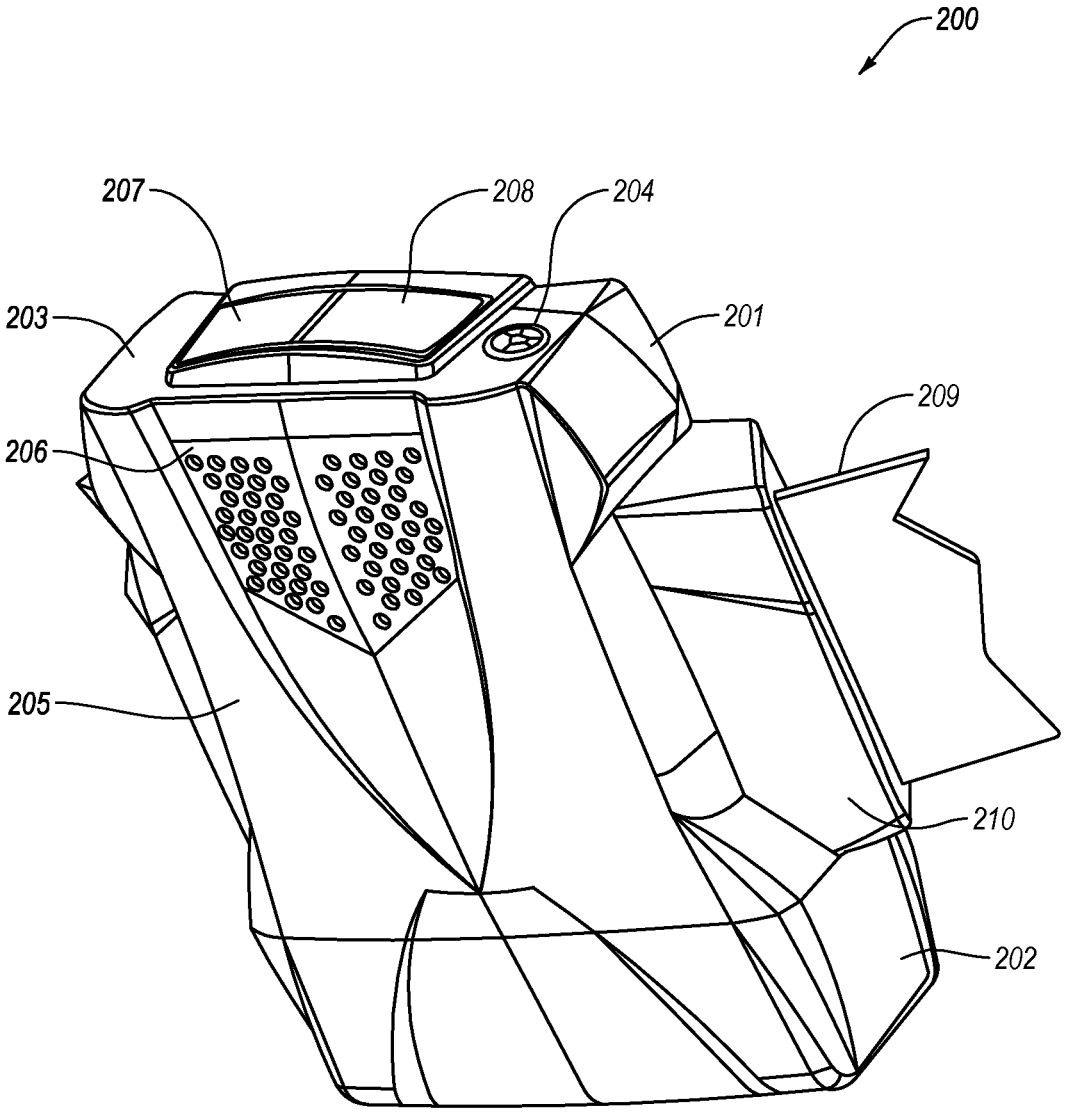
FIG. 2 illustrates a perspective view of a remote tracking and communication device.

Referring now to FIG. 2, an embodiment of the physical characteristics of a remote tracking device 200 according to the concepts described herein is shown in greater detail. Device 200 includes housing 201 with battery 202 removably affixed thereto. Battery 202, which is inserted into the bottom side of device 200, includes a release lever (not shown) which is movable to release the battery from the housing. In other embodiments, however, the battery is integrally connected to the tracking device and is not readily detachable, but is instead housed within the housing 201.

The single housing 201 is configured to contain all electrical components necessary for tracking and communicating with the individual wearing device 200. Battery 202 provides power to the electronic circuitry within housing 201, as described below, and is preferably rechargeable. Top side 203 of housing 201 includes a first set of through ports 204. Another side 205 of housing 201 includes a second set of through ports 206. The first set of through ports 204 is configured to allow sound to pass through to a microphone (not shown) disposed within housing 201, while the second set of through ports 206 is configured to allow sound to pass outward from a speaker (not shown) which is also disposed within the housing 201. Top side 203 of housing 201 also includes two panels 207 and 208, at least one of which is configured as a rocker button to activate one or more of the electronic components described below.

The rear face of device 200 includes an appropriate curvature so that it can be attached to a person's body, preferably to an ankle, or to another object. Each end of a strap 209 (partially shown) is secured within an extension on each side of housing 201, such as extension 210. Strap 209 and the strap connections to housing 201 are tamper resistant and include security measures intended to prevent the disconnection or severing of strap 209, or if strap 209 is severed, device 200 can provide a signal indicating the status of the strap. The strap preferably includes one or more optical fibers and/or conductive materials embedded throughout its length, each of which is exposed at either end of the strap and connected to the electronics in device 200 which can determine the integrity of the connections, as described in more detail below.

Additional tamper detection may be achieved through monitoring all externally accessible fasteners, e.g., the screws affixing the pressure block to the housing, the battery, and the like, for electrical continuity by using each fastener to complete, or as part of, an electrical circuit.

Figure 3:
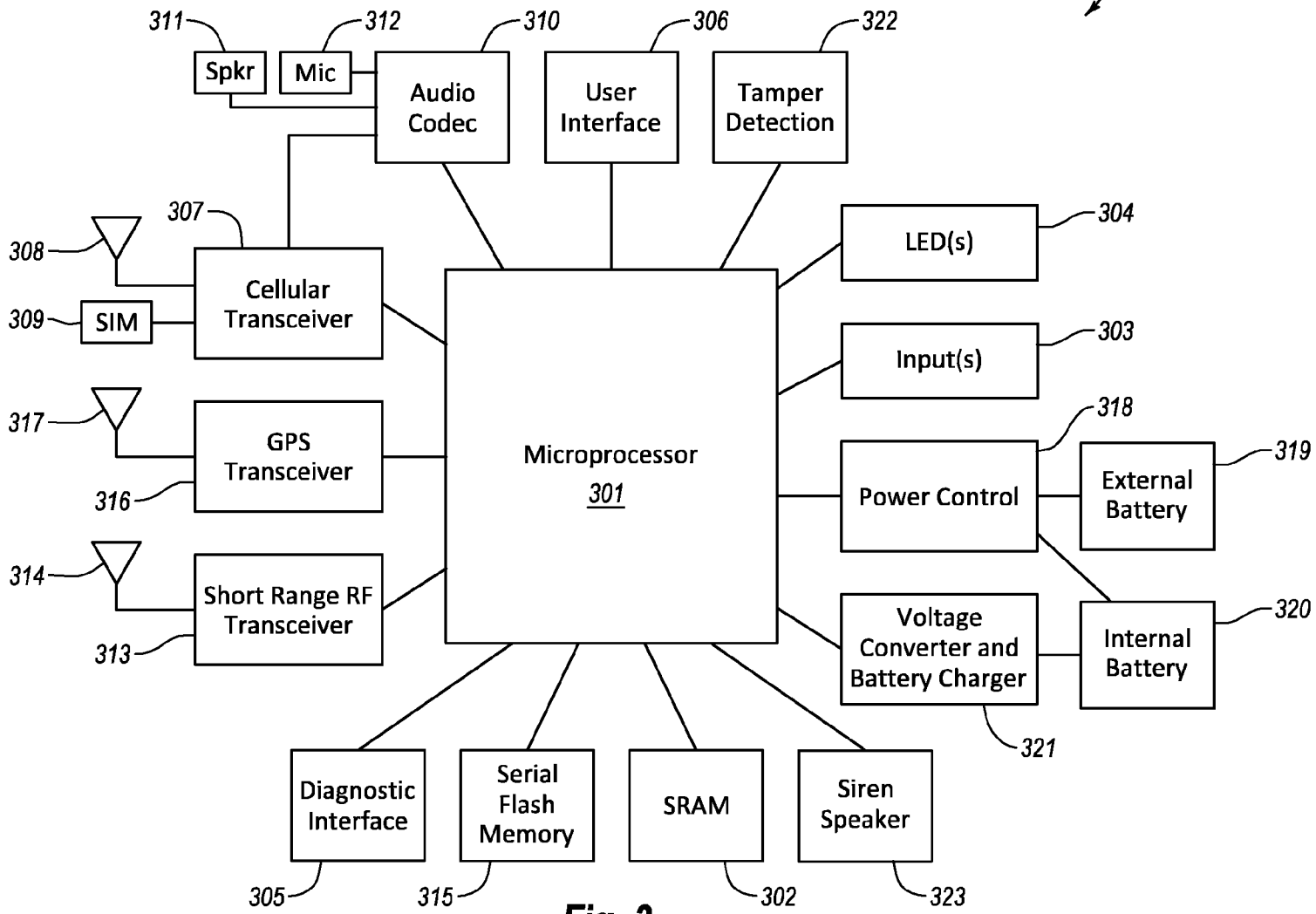
FIG. 3 illustrates a block view of electrical components included in a remote tracking and communication device.

Referring now to FIG. 3, an embodiment of the electronic aspects of the remote tracking device is shown. Electronics 300 includes microprocessor 301 which controls overall operation of the device according to programming stored in memory 302, which can be SRAM memory. Memory can include any combination of volatile and non-volatile storage medium. Electronics 300 also include inputs 303, which can be inputs such as switches or buttons that operate as inputs to microprocessor 301 and can be used to input data or provide for activation of pre-designated functionality controlled by microprocessor 301. In some embodiments of the tracking device, there is one button dedicated for activation of voice communications with the monitoring center. LEDs 304 are used as function and status indicators. The programming (e.g., computing modules/computer executable instructions) stored in memory 302 may be placed there at the time of manufacture, and additional, new or modified programming may be uploaded to the device using a wired connection via the included diagnostic interface 305, user interface 306, or wirelessly via the cellular transceiver 307 received by antenna 308.

Cellular transceiver 307 may be of the GSM/GPRS variety, and may include a SIM card 309. Cellular transceiver 307 allows two-way voice and data communication between the remote device and the monitoring center 104 from FIG. 1. Voice communications are further enabled by a direct connection between cellular transceiver 307 and an audio codec 310, which encodes and decodes the digital audio signal portion of the wireless transmission, and an associated speaker 311 and microphone 312. Notably, the cellular transceiver 307 may be directly connected to an integrated speaker (such as speaker 311) and microphone (such as microphone 312). Data communications preferably use the cellular data channel and/or the cellular control channel, which can make use of short message service (SMS) capabilities in the network. This has additional benefits in that it provides redundancy for cellular systems in which service for both types of data communication is supported. Also, for those cellular systems in which the voice channel cannot be used simultaneously with the data channel, or in which the data channel is simply unavailable, the control channel can provide a data link between the call center and the device.

Electronics 300 also include, in some embodiments, a short range wireless transceiver 313 and associated antenna 314 which, if included, allows for short range wireless voice and data communications with peripheral devices. This second wireless transceiver 313 can be chosen to utilize the wireless communications standard published by the ZigBee Alliance or another communication standard, including but not limited to Bluetooth technologies. Accordingly, it will be appreciated that wireless transceiver 313 may be designed and implemented using any of the alternative wireless communication standards which are well known in the art. Microprocessor 301 can be programmed to pass through voice communications received by cellular transceiver 307 to a voice-capable peripheral when such a peripheral is employed in conjunction with the remote tracking and communication device and is activated. Voice communications received from a voice enabled peripheral can be passed through to cellular transceiver 307 for transmission. Data generated by the device or received from a peripheral, if any, may be stored by microprocessor 301 in memory 315, which can be non-volatile memory such as serial flash memory until required by microprocessor 301 or until it is to be transmitted by the device.

GPS receiver 316 and antenna 317 receive signals transmitted by GPS satellites, the signal used to establish the geographical location of the device and the person being monitored. In one embodiment, data from GPS receiver 316 is passed through to microprocessor 301, which in turn processes the data to determine a location and associated time, and stores it in the serial flash memory 315 pending transmission using cellular transceiver 307. While electronics 300 are shown with a GPS receiver which passes the GPS signal data to the microprocessor for processing, a GPS engine which includes both the GPS receiver and the capability to process the GPS signal to produce a location determination and associated time indication may also be used according to the concepts described herein. Using a standalone GPS engine frees up processing bandwidth in the microprocessor, according to some embodiments, thereby allowing the microprocessor to perform other additional functions or generally improving responsiveness and processing capabilities of the tracking device.

Cellular transceiver 307 may also be used to geographically locate the device through any appropriate methods, including well known methods of cell tower triangulation, or may be used to provide location information used in assisted GPS schemes. Geographical location using cellular transceiver 307 may be performed in addition to, in conjunction with, or as a substitute for the GPS receiver 316. Other known methods for geographically locating the device may also be employed.

Either of memories 302 and 315, or memory resident on the microprocessor, may be used individually, or may be used in any combination to store the operating program and parameters for the operation of the device and may further be used to store prerecorded messages which can be played through speaker 311 as part of the monitoring and alarm management system in response to a received command or detected alarm condition.

A siren/speaker 323 may also be included in the device and controlled by microprocessor 301. Siren 323 is used as part of the alarm system to provide a high decibel audible alarm. This alarm can both warn those in the vicinity that the person being monitored has entered an exclusion zone or left an inclusion zone, and can aid the police in the location of the person being monitored. The siren can be activated automatically by the microprocessor as part of the alarm management system in response to a locally detected alarm condition or can be activated remotely by sending a signal to the microprocessor using cellular transceiver 307.

Siren 323 can be a separate device or could be combined with the functionality of speaker 311. LED light emissions can also be activated with the speaker in response to an alarm condition or a command received from a remote source. Tamper detection circuit 322 monitors the condition of strap 209 from FIG. 2 and any other tamper detection sensors that may be part of housing 201.

In the embodiment shown in FIG. 3, power to the processor and other electronic components is provided though power controller 318 by one or more internal and/or external batteries, such as external battery 319 and/or internal battery 320.

In embodiments that utilize an external battery, external battery 319 is removable and is preferably rechargeable by a separate recharging unit. Also, a person being monitored will preferably have multiple external batteries so that a charged external battery can be immediately inserted when a discharged battery is removed.

Internal battery 320 is preferably internal to the housing and not accessible by the person being monitored. The internal battery allows the device to continue to operate normally while the external battery is being replaced (for embodiments that utilize an external battery). If an external battery is used, the internal battery is intended to supply power to the device only during the transitioning from a depleted external battery to a charged external battery, or to provide a short amount of time to acquire a charged battery. Accordingly, the internal battery does not need to have a large capacity and can be charged using power from external battery 319 using voltage converter 321 and/or a battery charger which may be connected to the device through voltage converter 321.

When an external battery is not used, the internal battery is provided with a sufficient capacity to be worn for many hours and, in some instances, days between recharging.

Since tracking device 200 is typically intended to be worn around the ankle of the person being monitored, the microphone and speaker used for two-way voice communication is a significant distance from the ears and mouth of the person being monitored. To compensate for this, a peripheral device may be used in conjunction with the tracking device to aid in the two-way voice communication. In one embodiment the peripheral device has the form factor of a watch and includes an internal speaker, an internal microphone, and an internal short range wireless transceiver. The microphone and speaker are positioned in the housing of the peripheral to better enable voice communications. The short range wireless transceiver is configured to use the same wireless communications standard as the tracking device to enable wireless voice and data communications between the device and the peripheral. A button can be included which, when pressed, causes a command signal to be sent to the tracking device. This command signal can be used to instruct the remote tracking and communication device to initiate two-way voice communications with the monitoring center. When the peripheral device is used for such voice communications, the peripheral device communicates wirelessly with the tracking device using the respective short range wireless transceiver of each respective unit, and the tracking device then uses the cellular transceiver to connect the voice communications with the monitoring center. The microphone and speaker in the tracking device can be disabled by the microprocessor when a peripheral device, such as described, is in use.

Using electronics such as those described above, or in similar embodiments anticipated by this invention, the remote tracking devices according to the concepts described herein may be programmed with a variety of useful features.

One such feature is the ability to track the geographical location of the individual wearing the device. Most frequently, the GPS receiver is used to determine the location of the device (and thus the wearer) at the time indicated in the GPS signals received from GPS network satellites. When the GPS is unable to determine the location, the cellular transceiver may be used to determine the location of the device using well-known cellular tower triangulation techniques. Once identified, the location of the device is passed to the microprocessor, which processes the data according to its programming and stores the data in the memory. The data can be sent at regular intervals to an appropriate entity such as a monitoring center, in response to a specific request and on demand, in grouped batches or in any other desired manner. Programming modules stored in the tracking device can also detect and track tampering with the tracking device and, even more specifically, with the mounting strap of the tracking device.

The specific electronic components of the tracking device which have been described above can be replaced or augmented with other special purpose or general-purpose computer hardware, including one or more additional processors and system memory. As described above, the tracking device includes memory which comprises physical and other computer-readable media for carrying or storing computer-executable instructions and/or data structures. Such computer-readable media can be any available media that can be accessed by a general purpose or special purpose computer system.

Notably, computer-readable media that store computer-executable instructions are computer storage media and are distinguished from computer-readable media that merely carry computer-executable instructions, such as transmission media. Thus, by way of example, and not limitation, embodiments of the invention can comprise at least two distinctly different kinds of computer-readable media: computer storage media and transmission media. The embodiments of the present invention can utilize any combination of the foregoing computer readable media.

By way of example, computer storage media includes RAM, ROM, EEPROM, CD-ROM or other optical disk storage, magnetic disk storage or other magnetic storage devices, or any other medium which can be used to store desired program code means in the form of computer-executable instructions or data structures and which can be accessed by a general purpose or special purpose computer.

Transmissions media, on the other hand, can include a network and/or data links which can be used to carry a desired program code means in the form of computer-executable instructions or data structures and which can be accessed by a general purpose or special purpose computer.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments (including Cloud computing environments) where local and remote computer systems, which are linked (either by hardwired data links, wireless data links, or by a combination of hardwired and wireless data links) through a network, both perform tasks. In a distributed system environment, program modules may be located in both local and remote memory storage devices.

Attention will now be directed to some of the specific structures which, according to some embodiments, can help facilitate tamper detection of the tracking devices and which can also help facilitate enhanced structural integrity of the tracking devices.

Mounting Strap Assembly

Figure 4:
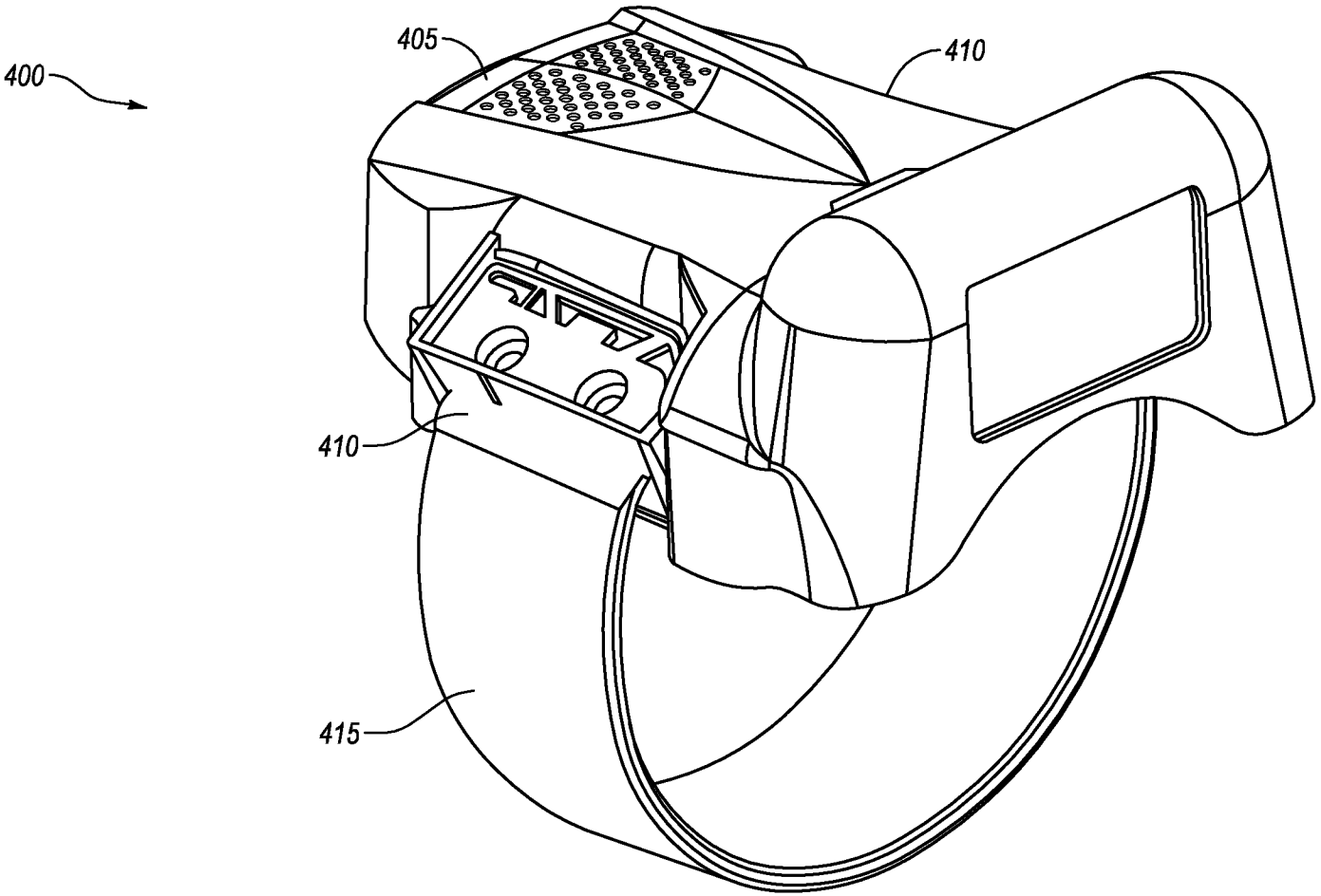
FIG. 4 illustrates a perspective view of a tracking device with a mounting strap.

FIG. 4 illustrates a tracking device 400 which is capable of being installed on an individual via a mounting strap 415. The cuff or mounting strap 415 is physically coupled to the tracking device 400 in such a manner that the mounting strap cannot be removed without an alarm being generated and sent to a corresponding monitoring center.

As mentioned above, one problem with some existing tracking devices is that the mounting strap that is used to secure the tracking devices can often be broken or cut, sometimes with only common scissors, and quickly removed. Once removed, the entity to which the device was affixed can quickly leave the area and escape monitoring and the tracking system altogether.

While the complete severing of a mounting strap and the removal of an existing tracking device can often generate an alarm, the speed at which existing straps can be cut is such that an offender, for example, will typically have ample time to flee the location where the tracking device was removed before enforcement authorities can be summoned to that location.

According to the present invention, the structural integrity of the mounting strap is augmented or reinforced with the structural support of one or more secondary straps that are composed of a cut resistant material and that are placed alongside the primary mounting strap. This strengthening of primary mounting strap with the one or more secondary straps results in a single integral mounting strap or assembly. Appreciably, this additional structural support makes it more difficult to completely sever the mounting strap (in addition to the secondary straps). Accordingly, prior to the mounting strap being completely severed, or destroyed, an alarm is generated and authorities are notified of the alarm, often with sufficient time to respond to the alarm and locate and apprehend the offender prior to the tracking device being removed from the offender. Accordingly, enhanced security of the strap can provide an early warning of attempts to tamper or remove the strap so that there is time for authorities to respond before the severing of the strap can be fully completed. It will be appreciated that the more time it takes to sever the attachment strap/cuff the more time authorities have to intervene.

As indicated above, the tracking device 400 contains electronic navigation (e.g., GPS), tamper detection and communication components which are enclosed in an electronic housing 405 typically composed of a structurally tough dielectric material. A dielectric material is used to facilitate transmission of the GPS and communication signals.

Mounting elements 410 are typically used to facilitate the secure mounting of the mounting strap 415 to the housing. Additionally, screws, bolts, or other fasteners may be used in such a manner that the mounted tracking device cannot be removed without severing or otherwise destroying the mounting strap.

Figure 5:
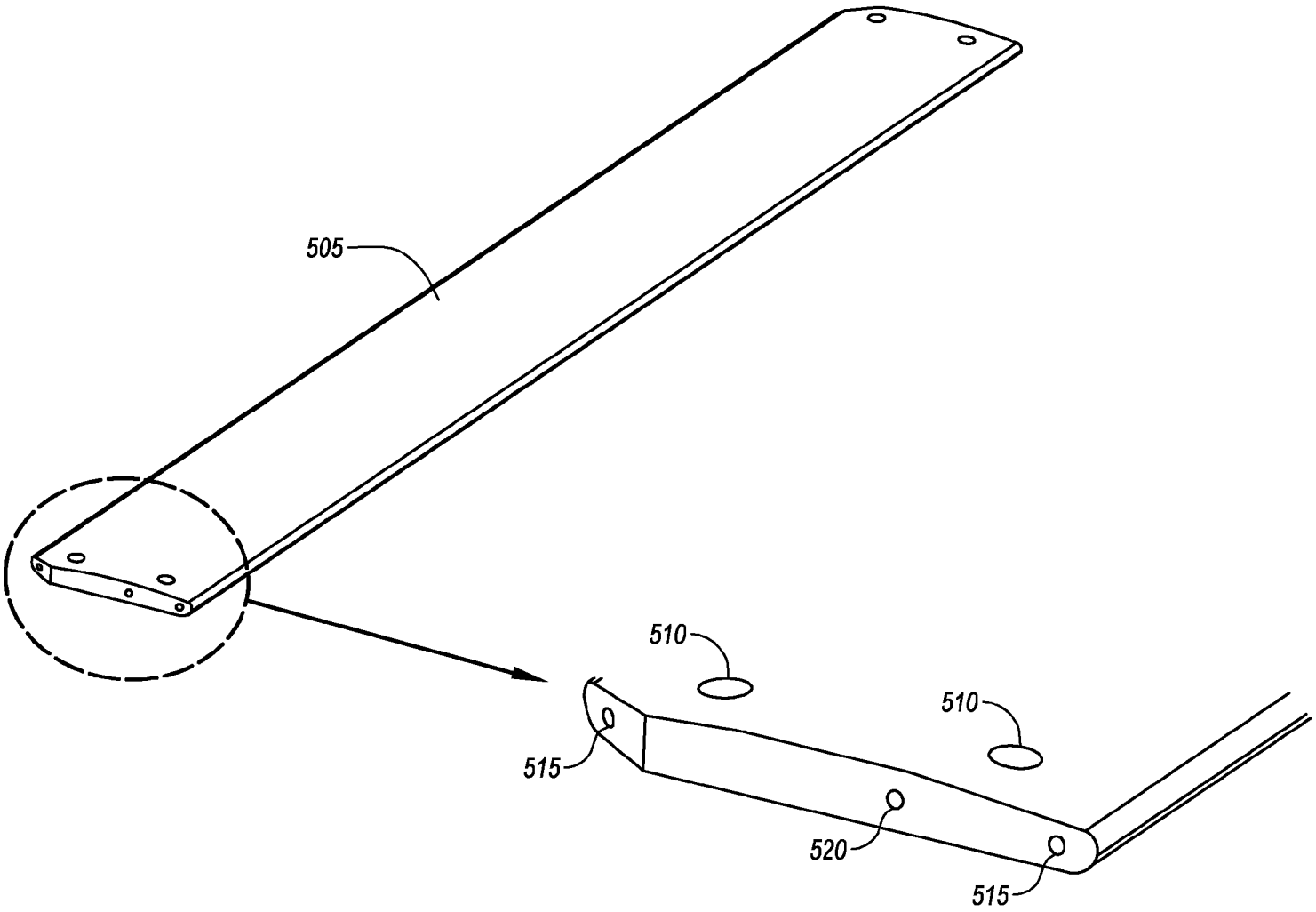
FIG. 5 illustrates a perspective view and an exploded view of a mounting strap for a tracking device.

Turning now to FIG. 5, a mounting strap 505 is illustrated for an offender tracking device. The illustrated mounting strap 505 is composed of a flexible plastic type material that may be extruded. The mounting strap can also be manufactured together or separately from one or more specific elements that are integrated into the mounting strap 505 for monitoring continuity and integrity of the mounting strap.

With respect to an enlarged end section view of mounting strap 505 of FIG. 5, for example, mounting holes 510 and metallic cables 515 are illustrated. The metallic cables 515 can, in some instances, add strength to the mounting strap 505 and can also be used to monitor the continuity thereof and can be, therefore, referred to as a continuity cable. Should any attempt be made to cut the mounting strap 505, the cable continuity would be broken and transceivers or other sensing elements contained within the electronic housing, which transmit and receive signals passed continuously or periodically through the metallic continuity cables, sense the resultant loss of continuity and cause an alarm to be generated.

Additional metallic conductors, such as foils or wires not used for adding strength to the mounting strap (not presently shown but comprehended) can also be added solely for the purpose of monitoring continuity of the strap so that the metallic cables shown can be used only for adding strength if desired.

Additionally, in some embodiments, the mounting strap 505 includes an optical fiber 520 whose purpose is to sense a severing of the mounting strap 505 with resultant alarms being generated in a manner similar to that described for an electrical cable. Optical transceivers and other circuitry within the tracking device can detect a break within the optical fiber.

It will be appreciated that any of the disclosed means for detecting a mounting strap being compromised or tampered with, such as the optical fibers, metallic conductors or metallic cables, or any other signal carrying elements which carry signals to the tamper detection circuitry in the housing of the tracking device can also be referred to herein as continuity cables.

While some existing tracking devices contain one or more continuity cables or alternative means for detecting a mounting strap being compromised, currently available tracking devices do not provide a means for detecting tampering as well as enhanced reinforcing means for causing the tracking device to remain attached to the individual for a sufficient time, after an alarm is triggered in response to tampering, to allow authorities to respond to the alarm and apprehend the individual before the tracking device is completely removed.

Figure 6:
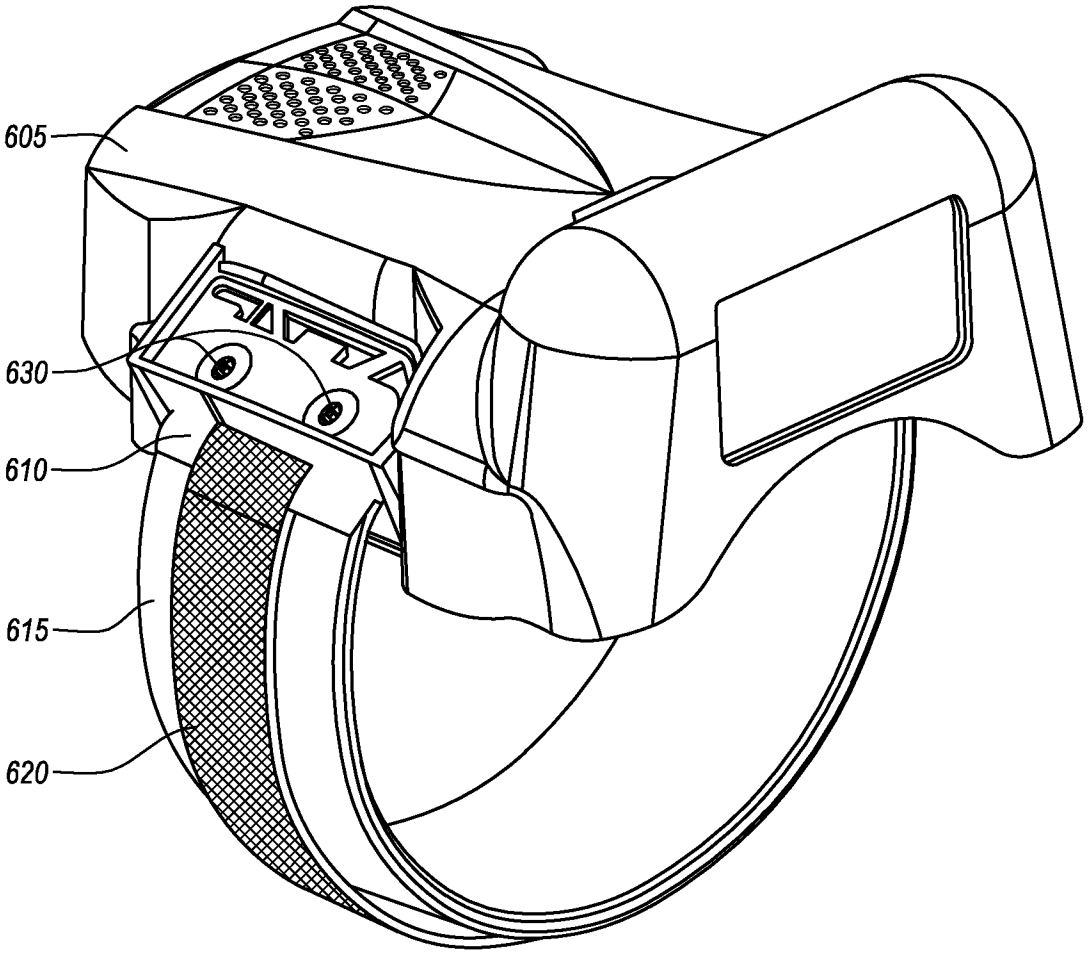
FIG. 6 illustrates a perspective view of a tracking device having a primary mounting strap and a cut resistant secondary support strap positioned on the outside of the primary mounting strap.

FIG. 6 illustrates one embodiment of a tracking device that has been reinforced and that can be used to overcome some of the problems experienced by prior art devices. As illustrated, the tracking device includes a cuff with a primary mounting strap 615 and a reinforcing secondary strap 620 composed of a cut resistant material. In one embodiment, the reinforcing strap 620 also covers continuity sensing elements, such as continuity wires or foils or optical fibers (not shown), placed along or within the primary mounting strap 615. An electronic shell 605 is affixed to the mounting strap 615 via a mounting element 610. A similar mounting element to mounting element 610 is also utilized, in some embodiments, on the other side of electronic shell 605 to help secure the mounting strap 615 to the tracking device. Alternatively, the mounting strap may be permanently affixed to one side of the electronic shell 605 in which case, only a single mounting element 610 is required.

As indicated, the primary mounting strap 615 includes a secondary strap 620 positioned alongside the primary mounting strap 615 which covers at least a portion of the primary mounting strap 615 to provide a barrier to resist complete severing of the mounting strap assembly.

In some embodiments, the cut resistant material of the secondary strap 620 cannot be cut through without first cutting or damaging the primary mounting strap 615 as well as the continuity sensing elements within the mounting strap assembly. Since the cut resistant material of the secondary strap 620 cannot be easily cut, additional time is required by an individual to complete the action of removing the offender tracking device. This can provide authorities sufficient time to be summoned and respond to the alarm generated in response to the initial cutting of or tampering with the mounting strap or tracking device, while the offender tracking device continues to remain affixed to the individual and while that individual can continue to be tracked.

Materials for the cut resistant material include, but are not limited to, metals, such as hardened steels, Kevlars, layered elastomerics, composites, ceramics and other such types of materials both natural and synthetic. Bonding or attachment of the secondary strap 620 to the primary mounting strap 615 may be accomplished with adhesives, rivets, clamps or any suitable combination of the above or other similar types of attachment means. The secondary strap 620 can also be mounted directly to the housing of the tracking device with any of the attachment means described above.

The thickness of the secondary strap 620 can vary in size. In some embodiments the secondary strap 620 has a thickness between 0.5 and 5 mm. In other embodiments the secondary strap 620 has a thickness of between 1 and 3 mm. Width of the secondary strap 620 is preferably narrower than the width of the primary mounting strap, although the widths can also be the same. In some embodiments, the width of the secondary strap 620 is within a range of about 6 mm and 25 mm. In other embodiments, the width of the secondary strap 620 is within a range of about 8 mm and 15 mm. Other dimensions can also be used.

The primary mounting strap 615 and the secondary strap 620 may also be enclosed or encased within another material such as, but not limited to, an elastomeric sheath, wrapping, sprayed materials, or other covering. In some embodiments, the primary and secondary straps can also be extruded together as a single laminate strap.

It will be appreciated that the secondary strap can be positioned along any portion of the primary strap 615. In some embodiments, the secondary strap 620 is affixed to the primary strap 615 and does not extend the entire length of the primary strap 615. In other embodiments, the secondary strap 620 extends along the entire length of the primary strap 615 and is coupled to the primary strap or directly coupled to the mounting element(s) 610 of the tracking device housing.

In another embodiment, the primary strap 615 is positioned on an opposing side of the hardened secondary strap 620, so that it will be cut prior to the hardened secondary strap 620 when the cuff is being cut from the outside in. This can provide additional notice to an appropriate party that an offender is attempting to cut off their tracking device (when the continuity elements in the primary strap are damaged or severed) and prior to the offender being able to actually cut through the hardened secondary strap 620.

It will be appreciated that the secondary strap 620 can also directly operate as part of the tamper detection means by completing a circuit through the mounting elements, the secondary strap and corresponding circuitry in the tracking device, such that the secondary strap 620 cannot be removed without destroying the continuity of the mounting strap assembly and triggering an alarm. In alternative embodiments, the mounting elements are electrically connected to the continuity wires and internal circuitry so as to form a circuit that can be used to detect tampering/removal of the mounting elements.

Figure 7:
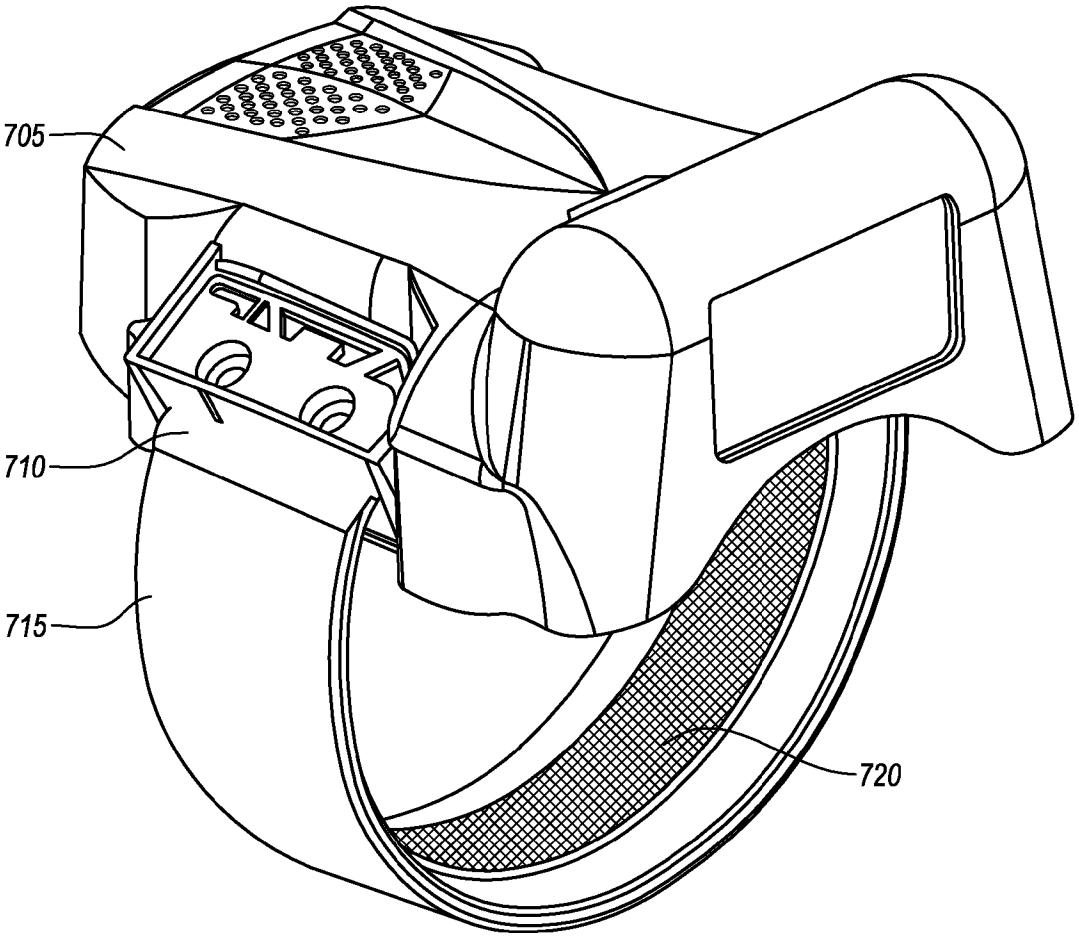
FIG. 7 illustrates a perspective view of a tracking device having a primary mounting strap and a cut resistant secondary support strap positioned on the inside of the primary mounting strap.

FIG. 7 illustrates another embodiment of a tracking device having a primary mounting strap 715 with a secondary cut resistant support strap 720 positioned along an inside surface of the primary mounting strap 715 and covering continuity sensing elements (described above).

As shown, a housing or electronic shell 705 is affixed to the mounting straps via a mounting element 710 with a similar mounting element on the other side of the electronic shell 705. Alternatively, the mounting straps may be permanently affixed to one side of the electronic shell 705 in which case only a single mounting element 710 is required.

The cut resistant material of the secondary strap 720 helps to prevent severing of the mounting strap assembly and removal of the tracking device during use. In some embodiments, for example, the cut resistant material cannot be cut without first cutting the primary mounting strap 715 or sensing elements above or around it, such as continuity wires or optical fibers, and thereby triggering an alarm in response to the signal discontinuity that results from the cutting or other damage to the sensing elements, as described above.

Since the cut resistant material of the secondary strap 720 cannot be easily cut, additional time is required by an individual to complete the action of removing the offender tracking device. This gives authorities sufficient time to respond to the alarm generated by the initial tampering of the primary mounting strap 715 and corresponding sensing elements, while the offender tracking device continues to remain affixed to the tracked entity or object, and such that the authorities can be summoned to the location of the tracking device prior to the tracking device being completely removed.

Materials for the secondary strap 720 include, but are not limited to, metals, such as hardened steels, Kevlars, layered elastomerics, composites, and other such types of materials both natural and synthetic. Bonding of the secondary strap 720 to the primary strap or the housing may be accomplished by adhesives, rivets, clamps or any suitable combination of the above, or other similar attachment means.

As indicated above, although not shown, the primary mounting strap 715 and the secondary strap 720 may also be encased within a material such as, but not limited to, an elastomeric sheath, wrapping, sprayed materials, or other materials. Such a covering can provide additional comfort to the individual wearing the tracking device and can further help obscure the visibility of the different components of the mounting strap assembly. The various mounting strap components be assembled or extruded together with single system.

Figure 8A:
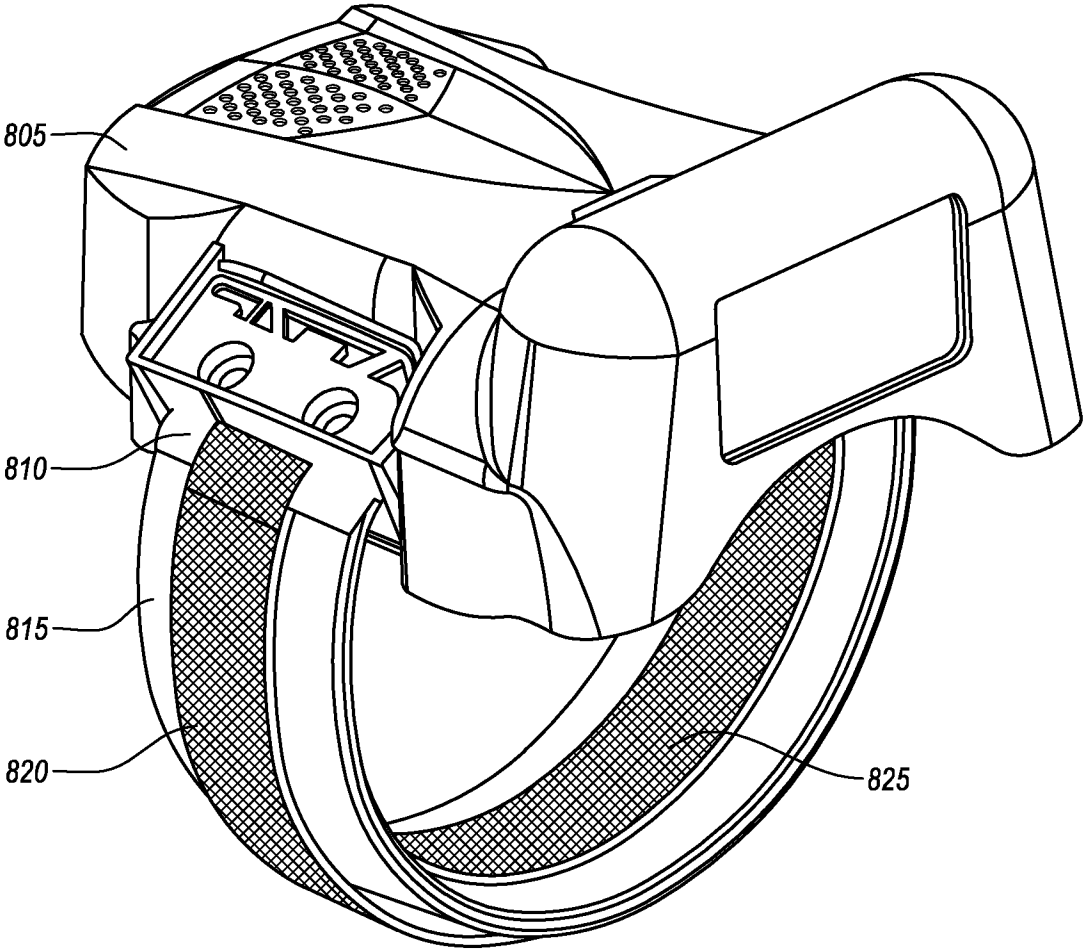
FIG. 8A illustrates a side perspective view of a tracking device having a mounting strap assembly that includes a primary mounting strap and two cut resistant secondary support straps positioned on opposing sides of the primary mounting strap.

FIG. 8A illustrates an embodiment of a tracking device that includes an electronic housing or shell 805 which is affixed to the cuff or mounting strap assembly via a mounting element 810 and, optionally, with a similar mounting element on the other side of electronic shell 805, as described above.

Circuitry, including a processor and memory, which are contained within the housing 805 facilitate the location detection, tamper detection, alarm notification, voice communication and the other tracking device functionality, as described above.

In the illustrated embodiment, the mounting strap assembly or cuff includes a primary mounting strap 815 having continuity sensing elements positioned between two secondary support straps 820 and 825 which are each composed of a cut resistant material, such as, but not limited to hardened steels, Kevlars, layered elastomerics, composites, ceramics and other cut resistant materials.

Preferably, the second and third mounting straps 820 and 825 cannot be cut without also cutting or destroying at least a portion of the mounting strap 815 and/or continuity sensing elements "sandwiched" between or next to the two layers of cut resistant material.

In some embodiments, the second and third mounting straps 820 and 825 are composed of the same material. In other embodiments, the second and third mounting straps 820 and 825 are composed of different materials. For instance, in one embodiment the second mounting strap is composed of a hardened steel band and the interior third mounting strap 825 is composed of a cut resistant fabric like Kevlar or another material. Such an embodiment can, in some instances, increase the comfort of wearing the tracking device. Alternatively, or additionally, all of the mounting straps 815, 820 and 825 can be encased together within a protective covering, such as a rubber or plastic coating, sheath or wrap. In other embodiments, the mounting strap 815 and the two support straps 820 and 825 are extruded together and manufactured as an integral mounting strap assembly.

As indicated above, tampering of the mounting strap assembly will result in the damage of the sensing elements of the detection means and will result in the generation of an alarm. Accordingly, when an offender attempts to remove the tracking device, an alarm will be generated. However, since the second and third support straps 820 and 825 are composed of a cut resistant material and are relatively more durable than the primary mounting strap and sensing elements of the detection means, additional time is required to complete the action of removing the tracking device once the tampering alarm is triggered. This gives authorities sufficient time to respond to the alarm, while the offender tracking device continues to remain affixed, and to be summoned to the location of the tracking device before it can be completely removed.

Figure 8B:
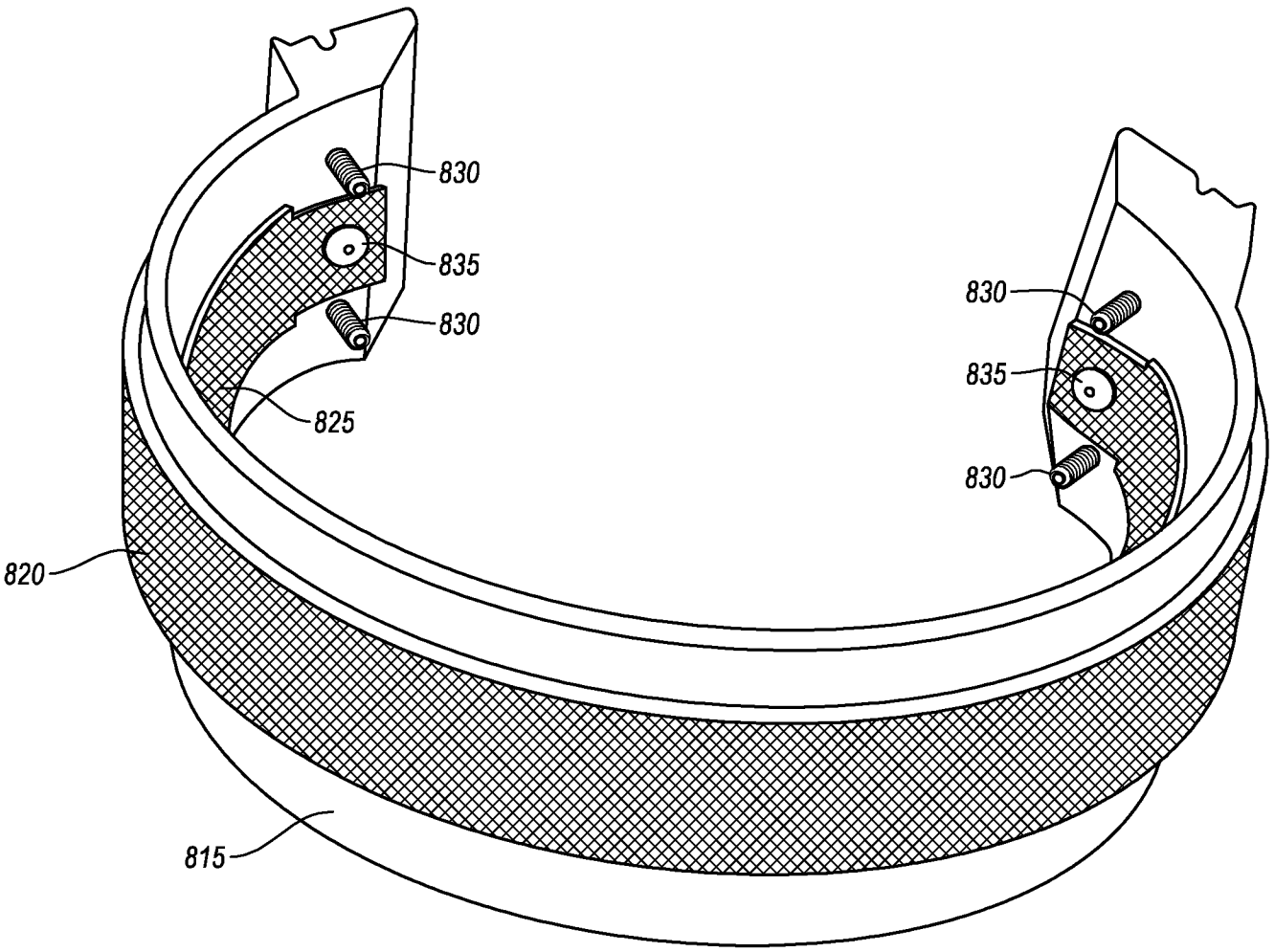
FIG. 8B illustrates another view of the mounting strap assembly of FIG. 8A which omits the tracking device.

As indicated above, the secondary support straps can be positioned along any desired portion of the primary support strap. In FIG. 8B, an illustration is provided in which the secondary support straps 820 and 825 extend the entire length of the primary mounting strap 815. In this illustration, attachment mechanisms, such as screws 830 are provided for securing the mounting strap assembly to the housing of a tracking device. (See also screws 630 of FIG. 6). Rivets 835 are also provided for securing the secondary support straps directly to the primary support strap 815. It will be appreciated, however, that the rivets can also be replaced with screws or other attachment means, including clamps or adhesives, to attach the secondary support straps to the primary mounting strap and/or directly to the housing of a tracking device, such as to the mounting elements described above.

Figure 9:
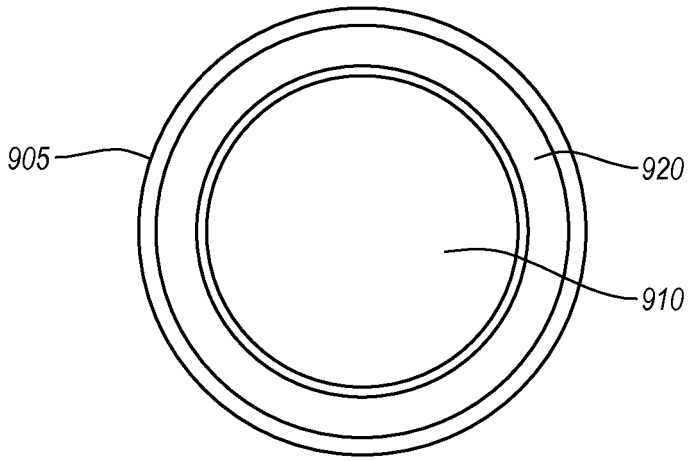
FIG. 9 illustrates a view of an optical fiber in a protective sheath for a mounting strap of a tracking device.

Turning now to FIG. 9, a cross section view of an optical fiber 910 encased within a protective sheath 905 is illustrated. The optical fiber 910 can be connected to optical transceivers in the tracking device to detect continuity and integrity of the optical fiber. When the continuity and integrity of the optical fiber is compromised, as a result of tampering, it is detected by the optical transceivers and other circuitry in the tracking device and a corresponding alarm is triggered. The alarm condition will be communicated wirelessly to a monitoring center and/or a responsible authority. Alarm conditions can also trigger audible alarms emitted from one or more speakers at the tracking device.

In some embodiments, the protective sheath 905 comprises the secondary support strap and is formed in a tubular shape that encases the optical fiber 910. This assembly can be placed alongside a primary mounting strap and/or integrated with the primary mounting strap. Any attempt to break or cut the secondary support strap will break the optical fiber and trigger an alarm. The cut resistant properties of the secondary support strap will prevent the secondary support strap from being completely cut or broken and thereby prevent the tracking device from being removed for a sufficient time after the initial tampering occurs for the authorities to track and apprehend the individual wearing the tracking device.

Materials for the protective sheath 905 include, but are not limited to, metals, such as hardened steels, Kevlars, layered elastomerics, composites, and other such types of materials both natural and synthetic. If the protective sheath 905 is metallic, it can also be separately monitored to sense its continuity.

In some embodiments, the optical fiber is encased in a plurality of different layered materials. For instance, a first layer encasing the optical fiber can be placed between the protective sheath 905 and the optical fiber within space 920. Alternatively, or additionally, at least one additional layer/sheath can be placed around the protective sheath 905. The additional layer that is placed over or under the protective sheath 905 comprises the primary mounting strap in some embodiments.

Figure 10:
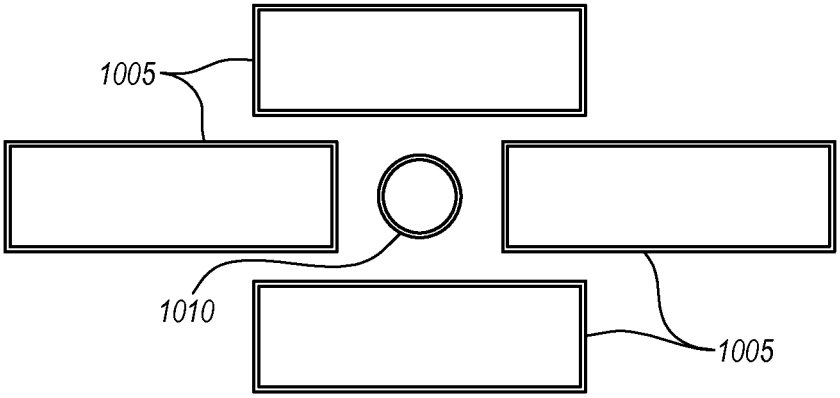
FIG. 10 illustrates a view of an optical fiber encompassed by multiple cut resistant materials for a mounting strap of a tracking device.

In view of the foregoing, it will be appreciated that the mounting strap assembly can define the shape of a tubular cable that includes the optical fiber (or alternatively a continuity wire) and the one or more protective layers. In other embodiments, as shown in FIG. 10, the mounting strap assembly defines a flattened strap shape. Other different shapes and configurations can also be used.

FIG. 10 illustrates an embodiment in which multiple cut resistant materials or support straps 1005 encompass an optical fiber 1010 for a mounting strap assembly in a more flattened strap shape. An internal cross section of the mounting strap assembly is shown, including the cut resistant materials 1005 surrounding the optical fiber 1010, which may be encased in one or more additional protective sheaths, as described above.

One benefit of surrounding, encasing or otherwise protecting the optical fiber with one or more protective support layers, straps or other reinforcing means is that any forces applied to the reinforcing means that would be necessary to sever or break the reinforcing means will apply a corresponding force, such as, but not limited to a compressive/crushing force, a shearing/tearing force, or a leveraging/bending force, to the tamper detection means (e.g., optical fiber, or other continuity sensing element) that is sufficient to create a discontinuity (such as by breaking the optical fiber) and to thereby trigger an alarm prior to the reinforcing means being completely broken. In some embodiments, the reinforcing means are sufficiently strong and durable to remain intact for a sufficient period of time after initial tampering of the mounting strap, which triggers an alarm, for an appropriate authority figure to be notified of the alarm and to arrive at the location where the tracking device is located, prior to the tracking device being completely removed.

In some embodiments, the optical fiber or, alternatively, the continuity wire, is intentionally manufactured and positioned within the mounting assembly in such a manner as to be relatively more fragile than the other elements in the mounting strap and the protective sheath. The optical fiber can also be positioned away from the support straps or other reinforcing means. This way, it is more likely that the optical fiber will be broken and the optical signal will be disrupted during any attempt to remove the offender tracking device by cutting, burning or stretching the mounting strap. Ample time will then be provided to notify the appropriate authorities of the attempted removal of the offender tracking device prior to the offender being able to cut through or remove the mounting straps, cables and/or protective sheaths.

In alternative embodiments, optical fibers or the continuity wires are utilized which have special cut resistant properties, to enhance the structural integrity of the offender tracking device and the mounting strap assembly in particular. The present invention comprehends the fact that the test for continuity can be individually and fully realized by the use of optical fiber (photonic conductivity), or the use of metallic materials (electrical conductivity), or any combination of the above for redundancy.

Figure 11:
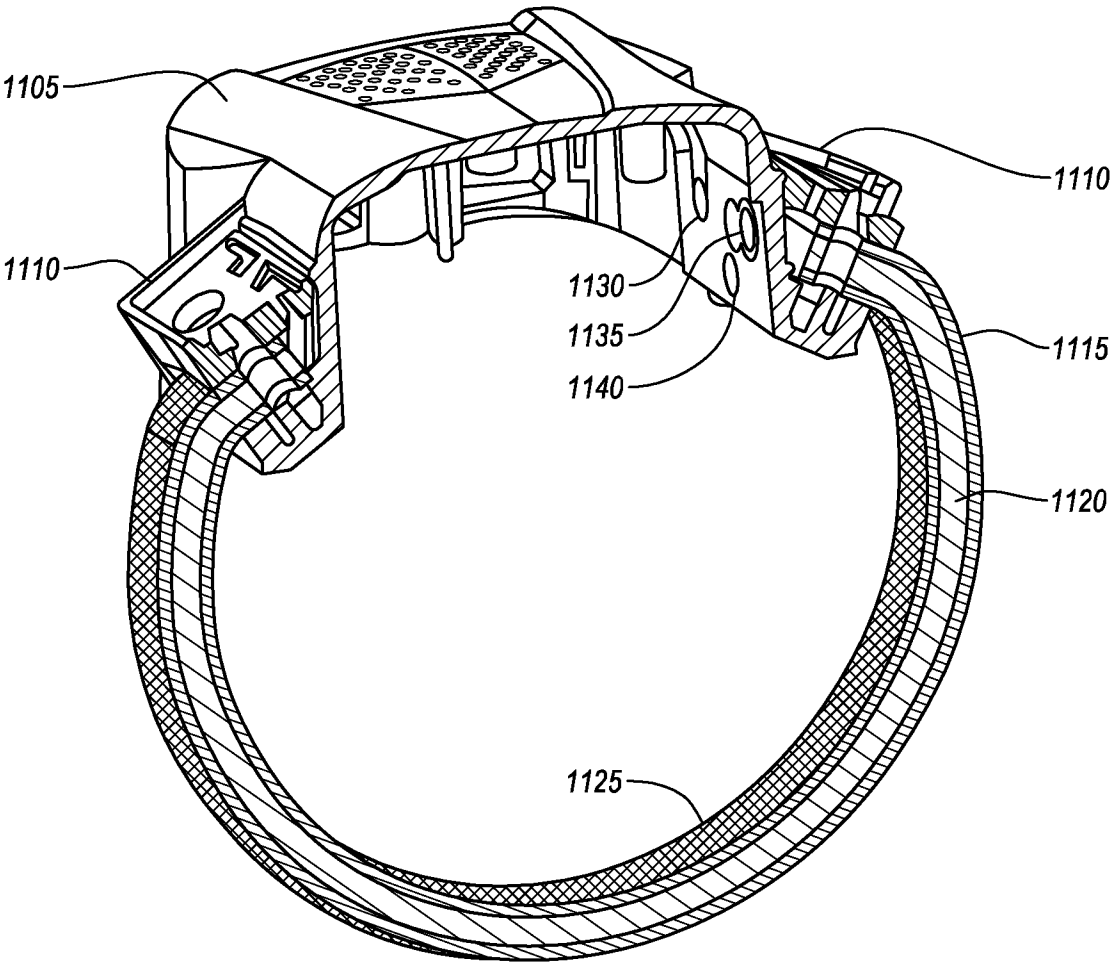
FIG. 11 illustrates a view of a mounting strap of a tracking device connected to the electronics housing of the tracking device and that also includes sensing elements which can be individually sensed for continuity.

FIG. 11 illustrates an embodiment wherein multiple elements of a mounting strap of an offender tracking device are individually sensed for continuity in accordance with the principles of the present invention. Shown is a cross section of an offender tracking device with an electronic shell 1105 to which is connected a composite mounting strap assembly by mounting elements 1110. Alternatively, the mounting strap may be permanently affixed to one side of the electronic shell 1105 in which case, only a single mounting element 1110 may be required.

The mounting strap assembly includes an outer metallic band 1115, a central dielectric band 1120 containing at least an optical fiber for sensing continuity, and an internal metallic band 1125, all of which are connected together and/or to the mounting element(s) 1110 or housing with any of the mechanical or chemical means previously described. Additionally, the mounting strap assembly, including the metallic band(s) 1115 and 1125 may also be encased within another material such as, but not limited to, an elastomeric sheath, wrapping, sprayed materials, or other such material or extruded together within a single system.

The thickness of the outer and inner metallic bands 1115 and 1125 can vary in size. In some embodiments they each have a thickness between about 0.5 and 5 mm. In other embodiments they each have a thickness of between 1 and 3 mm. However, the thicknesses of the two metallic bands can vary from one another, as can their widths. Preferably, the width of each metallic band 1115 and 1125 is narrower than the width of the central dielectric band, although their widths can also be the same. In some embodiments, the width of the metallic bands is within a range of about 6 mm and 25 mm. In other embodiments, the width of the metallic bands is within a range of about 8 mm and 15 mm. Other dimensions can also be used.

The outer and inner metallic bands 1115 and 1125 provide enhanced reinforcement to the mounting strap assembly and can optionally be used to provide electrical continuity via electrical connections 1130 and 1140, respectively, through the mounting elements 1110 and into the electronic shell 1105. The optical fiber from the central dielectric band 1120 also provides optical continuity via an optical connection 1135 through the mounting elements 1110 and into the electronic shell 1105. A continuity wire can also be used with an appropriate electrical transceiver, in combination with, or as a replacement for the optical fiber sensing elements. Thus, each band of the mounting strap can be individually and uniquely monitored for continuity. Should continuity be broken in any one path, it can be sensed via electronics contained with the electronic shell 1105, an alarm generated and communicated to the appropriate data or monitoring center and/or authority figure(s).

When multiple continuity signals are monitored independently, each continuity signal can optionally be tied to a different alarm so as to provide a monitoring system/agent with an ability to detect progressive destruction/removal of the tracking device and to thereby more fully appreciate the urgency associated with certain alarm conditions and even, potentially, a complete removal of the tracking device. In such situations, a responding authority can be informed to be on the lookout for individuals fleeing an area where the tracking device is located. However, it is preferable that the alarm notification for any detected alarm condition is sent to the appropriate authorities before the tracking device can be completely removed.

Gap Protective Flap

Figure 12:
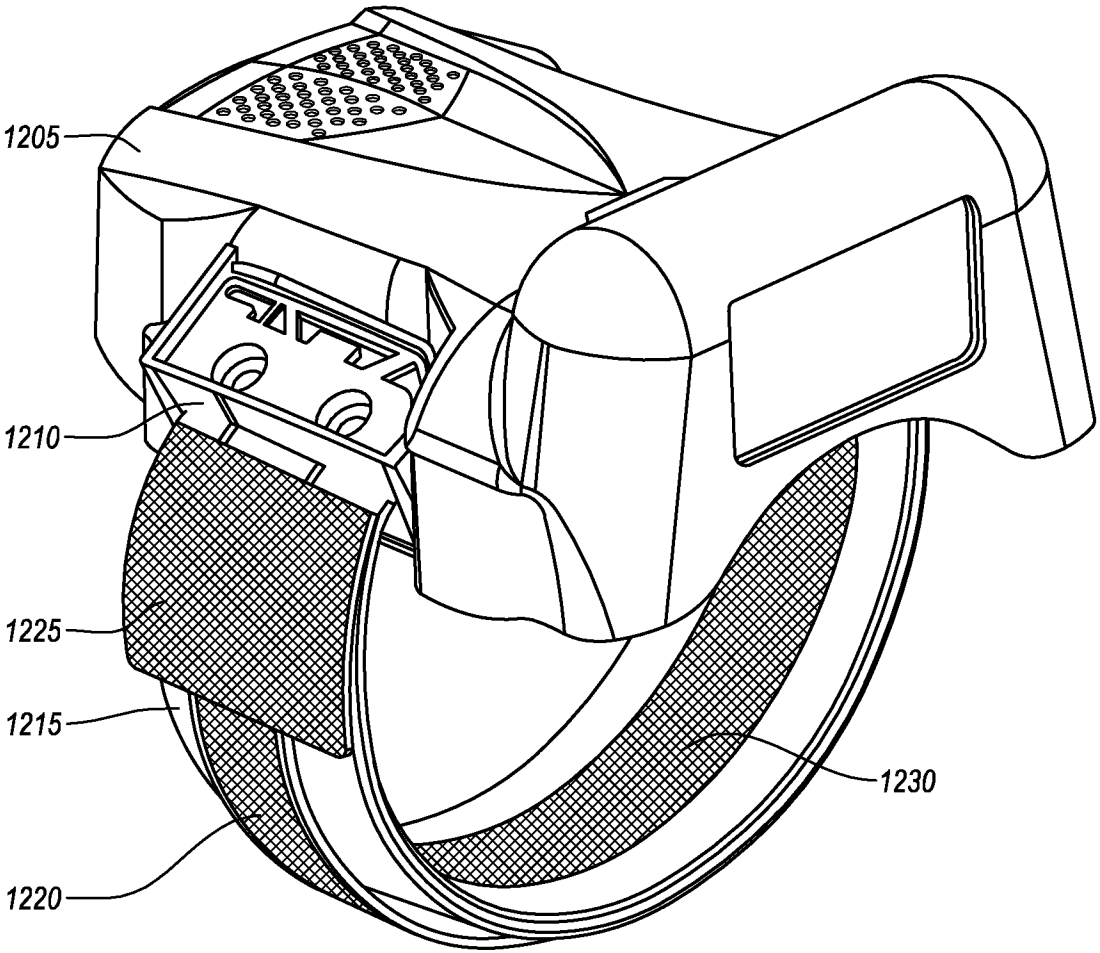
FIG. 12 illustrates a view of a tracking device having a mounting strap assembly that includes a primary mounting strap and two support straps as well as another cut resistant material added to a vulnerable part of a mounting strap assembly.

FIG. 12 illustrates another concept of the present invention. In particular, an additional cut resistant material is added to a vulnerable part of a mounting strap 1215 of a tracking device to further deter and prevent cutting of the mounting strap assembly or cuff. As shown, an electronic shell 1205 is affixed to the mounting strap 1215 via a mounting element 1210 and, optionally, with a similar mounting element on the other side of electronic shell 1205. Alternatively, the mounting strap may be permanently affixed to one side of the electronic shell 1205 in which case, only a single mounting element 1210 may be required. The mounting strap 1215 includes at least one of first and second cut resistant reinforcing straps 1220 and 1230 positioned above and beneath, respectively, at least a portion of the primary strap to provide a barrier to resist cutting of the primary mounting strap 1215. The first and second support straps 1220 and 1230 cannot be cut without also cutting the mounting strap 1215 and triggering an alarm in response to resulting damage caused to sensing elements within the mounting strap 1215, as discussed above.

In this present embodiment, the mounting strap 1215 also includes an additional cut resistant structure or gap flap 1225 that is affixed to the mounting strap 1215 proximate the housing near each mounting element 1210 location, or in the case of the mounting strap being permanently affixed to the electronic shell 1205, the second cut resistant material 1225 is also permanently mounted at that same location proximate the housing or shell 1205 of the tracking device.

Due to the anatomical nature of the human leg and ankle, where the tracking device is typically worn, a necessarily larger gap between an individual's leg and the mounting strap 1215 may exist near the mounting element(s) 1210 or correspondingly at an area close to where the mounting strap 1215 approaches the electronic shell 1205. By including the gap flap or other cut resistant structure 1225 on each side of the electronic shell 1205, another barrier is created at the location where a gap would otherwise be formed between the mounting strap and the leg or object where the tracking device is mounted, thereby making it more difficult to position a cutting instrument around the mounting strap and further increasing the amount of time required to remove the offender tracking device in an unauthorized manner.

Materials for the cut resistant structure 1225, as with the first and second support straps 1220 and 1230 include, but are not limited to, metals, such as hardened steels, Kevlars, layered elastomerics, composites, and other such types of materials both natural and synthetic. Bonding of the cut resistant structure 1225 and the support straps 1220 and 1230 to the primary mounting strap 1215 and/or the shell 1205 of the tracking device may be accomplished by adhesives, rivets, screws, bolts, clamps other similar chemical or mechanical attachment means or any suitable combination of the above. When the cut resistant structure 1225 and the support straps 1220 and 1230 are metallic, welding may also be a suitable means of attachment.

Additionally, the cut resistant structure 1225 and the support straps 1220 and 1230 may also be enclosed or encased within a material such as, but not limited to an elastomeric sheath, wrapping, sprayed material, or other such material or extruded together within a single system. The mounting strap 1215 and the first, second and third cut resistant materials 1220, 1230 and 1225 may also be surrounded, at least in part, by an external layer.

Figure 13:
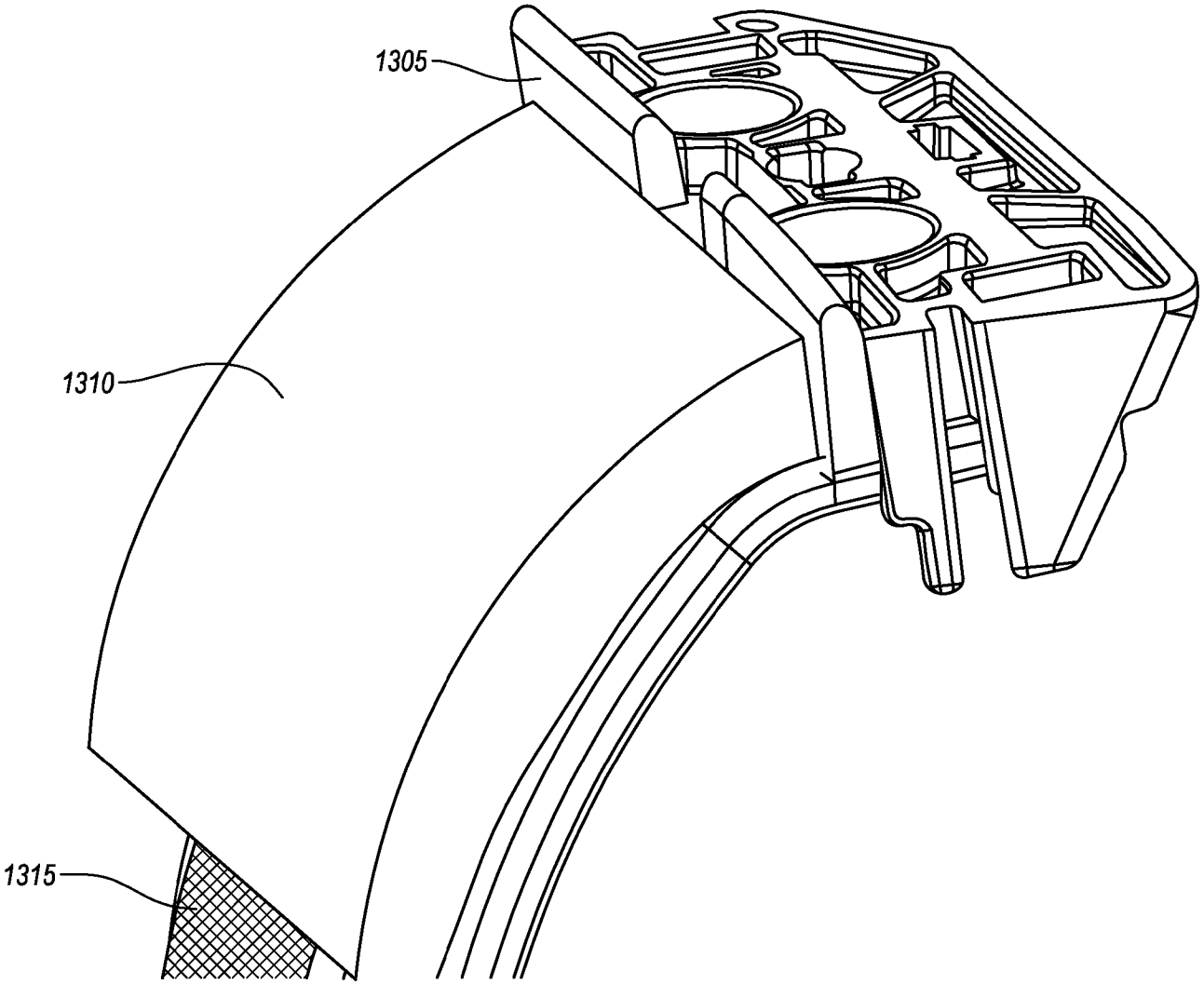
FIG. 13 illustrates a view of a cut resistant element which is added to a vulnerable part of a mounting strap of a tracking device.

FIG. 13 illustrates a portion of a mounting strap assembly that includes a cut resistant element 1310 added to a vulnerable part of a mounting strap 1315. The mounting strap 1315 may include cut resistant materials as described above. In this embodiment, the mounting element 1305 has been enhanced to include the additional hardened metallic or cut resistant element 1310. The cut resistance element 1310 performs a function similar to the third cut resistant structure 1225 described with respect to FIG. 12 above. Although only one side of the mounting strap assembly is shown in FIG. 13, two cut resistant elements 1310 would be present if two mounting elements 1305 were used, one on each end of the mounting strap 1315. In the event the mounting strap 1315 was permanently affixed to one side of an electronic shell, the cut resistant element 1310 can also be permanently affixed about that same location instead of using a removable mounting element in that location.

Figure 14:
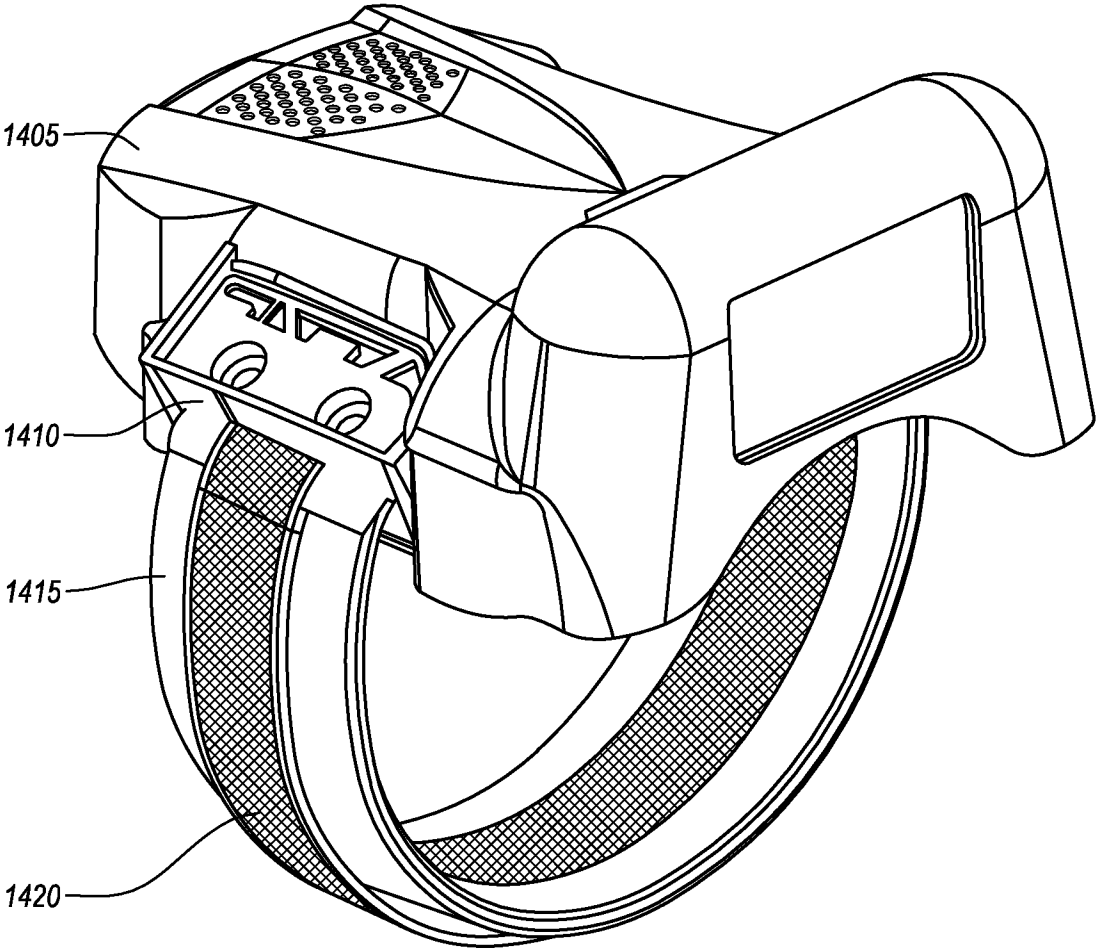
FIG. 14 illustrates a view of a tracking device having a reflective strip added to the mounting strap assembly for facilitating detection of the tracking device.

Turning now to FIG. 14, illustrated is a view of an embodiment wherein a reflective strip 1420 is added for ease of detection to a mounting strap 1415 of a tracking device. As shown, an electronic shell 1405 is affixed to the mounting strap 1415 via a mounting element 1410 with a similar mounting element on the other side of electronic shell 1405. Alternatively, the mounting strap may be permanently affixed to one side of the electronic shell 1405 in which case, only a single mounting element 1410 is required. The mounting strap 1415 may include cut resistant materials as introduced above. In spite of all measures taken to thwart the unauthorized removal of the offender tracking device from an individual, should such a removal be successful and the offender tracking device discarded, the addition of the reflective strip 1420 provides an aid to determine the location of the offender tracking device in the event it is rendered inoperative and is discarded in an area with multiple obstacles such as, but not limited to, grasses, bushes, leaves and refuse.

The reflective strip 1420 can be affixed to the mounting strap with an adhesive or mechanical fastener. One or more other reflective elements (not shown) can also be affixed to the shell 1405 in addition to or instead of the mounting strap.

Other detection means can also be used in combination with or without the reflective strip. For instance, an audible alarm, such as a constant sound or periodic beep, can be used and activated once the mounting strap has been tampered with or removed, such as by detection of a loss of signal continuity (electrical or optical), as described above. This audible alarm can be emitted from a speaker operably coupled to the offender tracking device. In other embodiments a visual alarm is activated, such as with a pulsing or constant light source, in response to a detected loss of signal continuity with any of the mounting strap elements described above. The light source can be disposed on any portion of the offender tracking device. In some embodiments, the light source is a low power LED light source that will continue to operate for several hours, thereby providing ample time to detect the device, even if the device is hidden or obscured in a dark location.

Attention will now be directed to FIGS. 15A-D, FIGS. 16A-D and FIG. 17, which illustrate another configuration of the tracking device and strap assembly or cuff.

It will be appreciated that the embodiments of FIGS. 15A-D, 16A-D and 17 can include any combination of the features and elements that have also been discussed, above, with respect to FIGS. 1-14. FIGS. 15A-D, 16A-D and 17 have simply been provided at this time to further illustrate some additional elements and features that can be selectively combined and utilized to provide enhanced security and durability.

FIGS. 15A-D illustrate cutaway views of a cuff or strap assembly of a tracking device that has been enhanced with cut resistant materials. As shown, the cuff or strap assemblies 1500*a-d* include a primary strap 1530*a-d*, which can be similar to the strap 615 in FIG. 6, strap 505 in FIG. 5, or any of the other straps described herein. By way of example, this primary strap 1530*a-d* can include continuity elements 1540*a-d*, which can help monitor integrity of the strap for generating an alarm and/or for notifying an appropriate party when the continuity elements 1540*a-d* are severed.

The cuff 1500*a-d* also includes a hardened band 1520*a-d* which can comprise any hardened material, as described above with reference to FIG. 6. An inner strap coating or strap layer 1510*a-d* can also be provided to enhance the comfort of the cuff when being worn by a person. This inner strap coating or layer 1510*a-d* can also be configured to wrap around or otherwise envelop the entire cuff assembly (such as with elastomeric coating or wrap).

As also illustrated, the cuff 1500*a-d* also includes a cut resistant material that is positioned between the primary strap and the hardened band 1520*a-d*. The cut resistant material is preferably configured to resist cutting, particularly cutting that occurs with a saw or other blade that is dragged back and forth across the cuff.

When an offender attempts to cut/saw through the cuff 1550*a-d* and the hardened band 1520*a-d*, the cut resistant material will gum up the saw blade and slide back and forth with the saw blade, resisting cutting of the hardened band 1520*a-d*. This can be particularly useful for providing additional time (after the primary strap and continuity elements 1540 have been damaged and an alarm has been triggered) prior to an offender being able to fully cut through and remove the cuff.

In some instances, it has been found that the addition of the cut resistant material can increase the amount of time needed to cut through the cuff significantly (by at least double). In one instance, for example, a cuff without the cut resistant material was able to be cut through in about 9 minutes and 5 seconds, whereas similar cuffs (having different cut resistant material layers) took about 22 minutes to cut through. In one instance, the cut resistant material was a double stack of (Tyvek®) sheets. In another instance, the cut resistant material was a basalt fiber woven/braided tube.

Figure 15A:
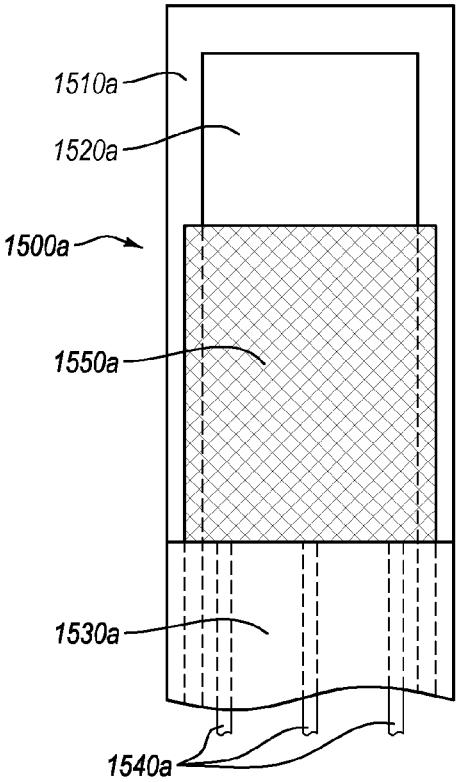
FIGS. 15A-D illustrate cut away top views of different cuff components that include cut resistant materials.
Figure 15B:
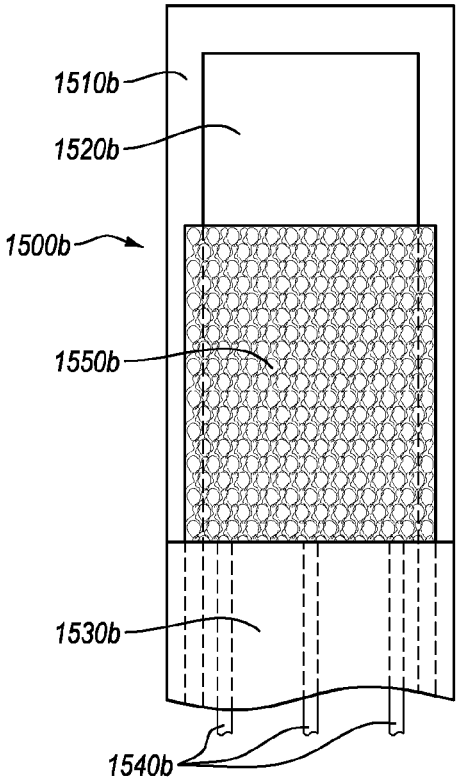
Figure 15C:
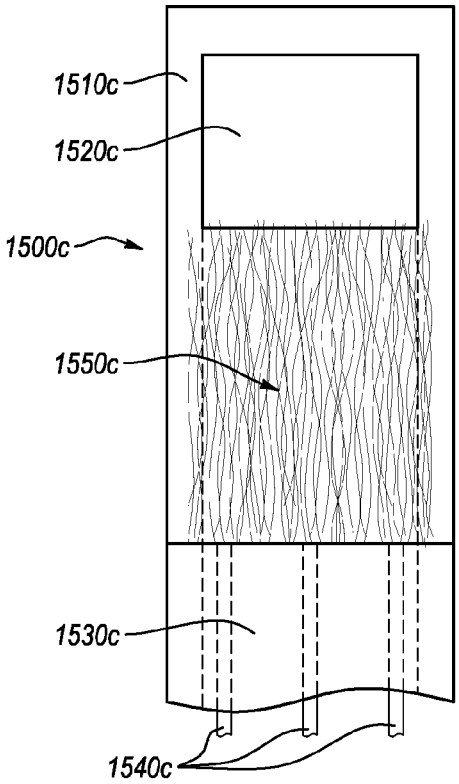

This cut resistant material can comprise a woven or braided material 1550*a* (as shown in FIG. 15A), a knitted material 1550*b* (as shown in FIG. 15B) or a stranded or mesh material 1550*c* (as shown in FIG. 15C). A knit or braid can be particularly beneficial because they can cause the cut resistant material to stretch in a plurality of different directions so that, irrespective of the specific orientation of the saw blade, the cut resistant material will be able to stretch/slide with the blade, resisting cutting of the material. Strings and cords can also be used in some embodiments.

Figure 15D:
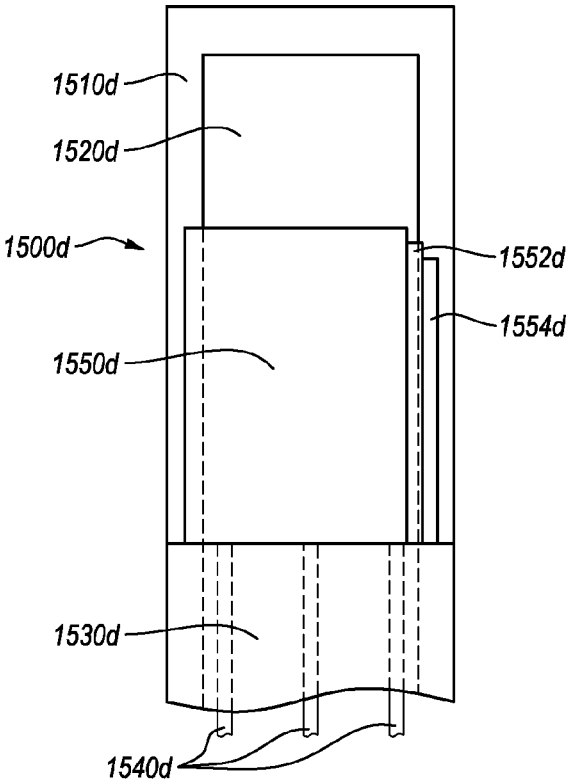
Figure 16A:
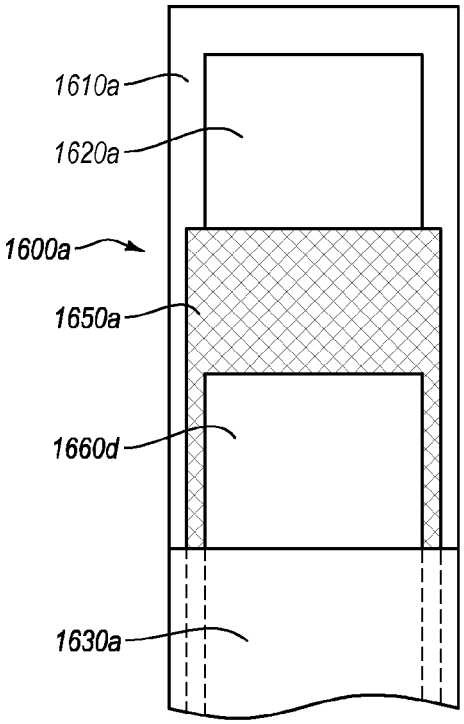
FIGS. 16A-D illustrate additional cut away top views of different cuff components that include cut resistant materials.
Figure 16B:
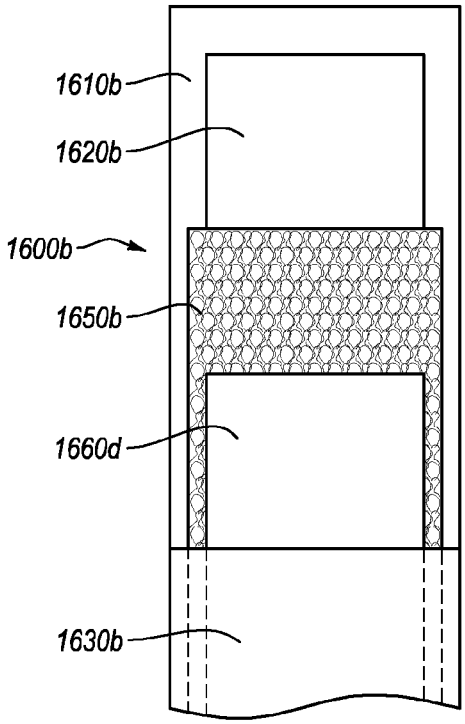
Figure 16C:
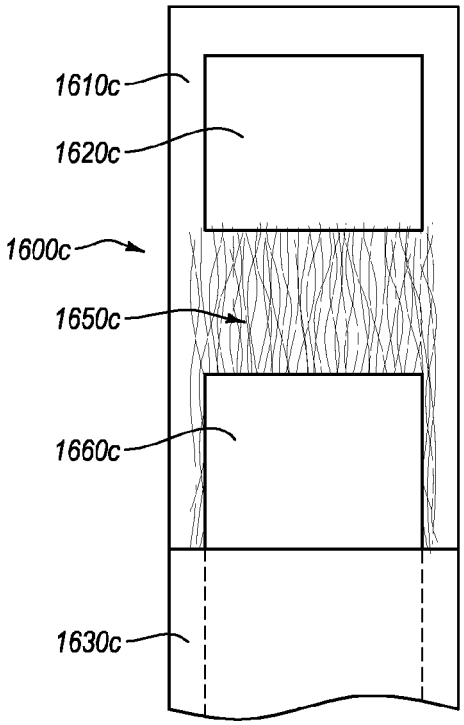
Figure 16D:
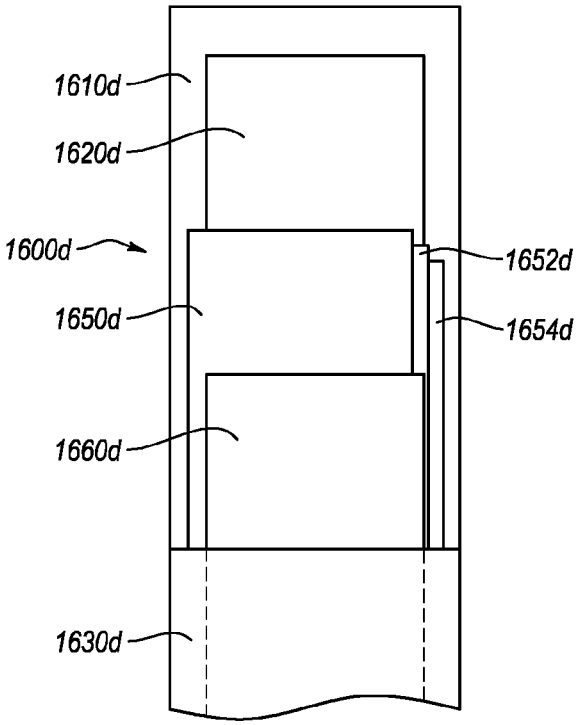

The cut resistant material can also comprise an assembly of different layers, such as the plurality of stacked sheets (1550*d*, 1552*d* and 1554*d*) shown in FIG. 15D. While three sheets are shown, it will be appreciated that the stacked sheets can include any quantity of two or more sheets of material that are cut resistant and that are preferably slidably engaged so that they will slide back and forth, relative to each other when an attempt is made to saw through the cuff.

Although not specifically shown, the cut resistant material can also include a combination of the foregoing materials in different layers. By way of example, a knitted material 1550*b* can be stacked on top of a woven material 1550*a*, a stranded material 1550*c* or a stacked sheet assembly (1550*d* and 1552*d*, or any other quantity of sheets).

The cut resistant material can also comprise a configuration of stacked layers of the same material, such as the sheets in FIG. 15D, or other materials that are layered on a single side of the hardened band. This can be done, for example, by stacking a plurality of individual components, such as the sheets of FIG. 15D, and/or by folding a single component into layers (such as a sleeve or tube configuration that is folded in half on top of the hardened band).

It will also be appreciated that the cut resistant materials can be positioned on both sides of the hardened band. The hardened band can also be omitted from the cuff, if desired.

The material composition of the cut resistant elements can vary to accommodate different needs and preferences. These materials can include fiberglasses, carbon fibers, aramids, plastics (including, but not limited to high density polyethylene materials like Tyvek® and other wafer papers), other synthetic materials and other cut resistant natural materials.

FIGS. 16A-D illustrate similar strap assemblies/cuffs 1600*a-d* as described with reference to the assemblies/cuffs 1500*a-d* of FIGS. 15A-D. In particular, these cuffs 1600*a-d* also include a primary strap 1630*a-d*, which can include continuity elements (although not presently shown), as well as an inner strap layer/coating 1610*a-d*, a hardened band 1620*a-d*. These cuffs 1600*a-d* also include cut resistant elements 1650*a*, 1650*b*, 1650*c*, 1650*d*, 1652*d* and 1654*d*, as previously described.

Unlike the cuffs 1500*a-d* of FIGS. 15A-D, however, the cuffs 1600*a-d* of FIGS. 16A-D also include an additional layer 1660*a-d*. This secondary layer 1660*a-d* can comprise an additional cut resistant material layer (similar to elements 1650*a-d*) or another hardened band (similar to hardened bands 1620*a*-1620*d*).

Figure 17:
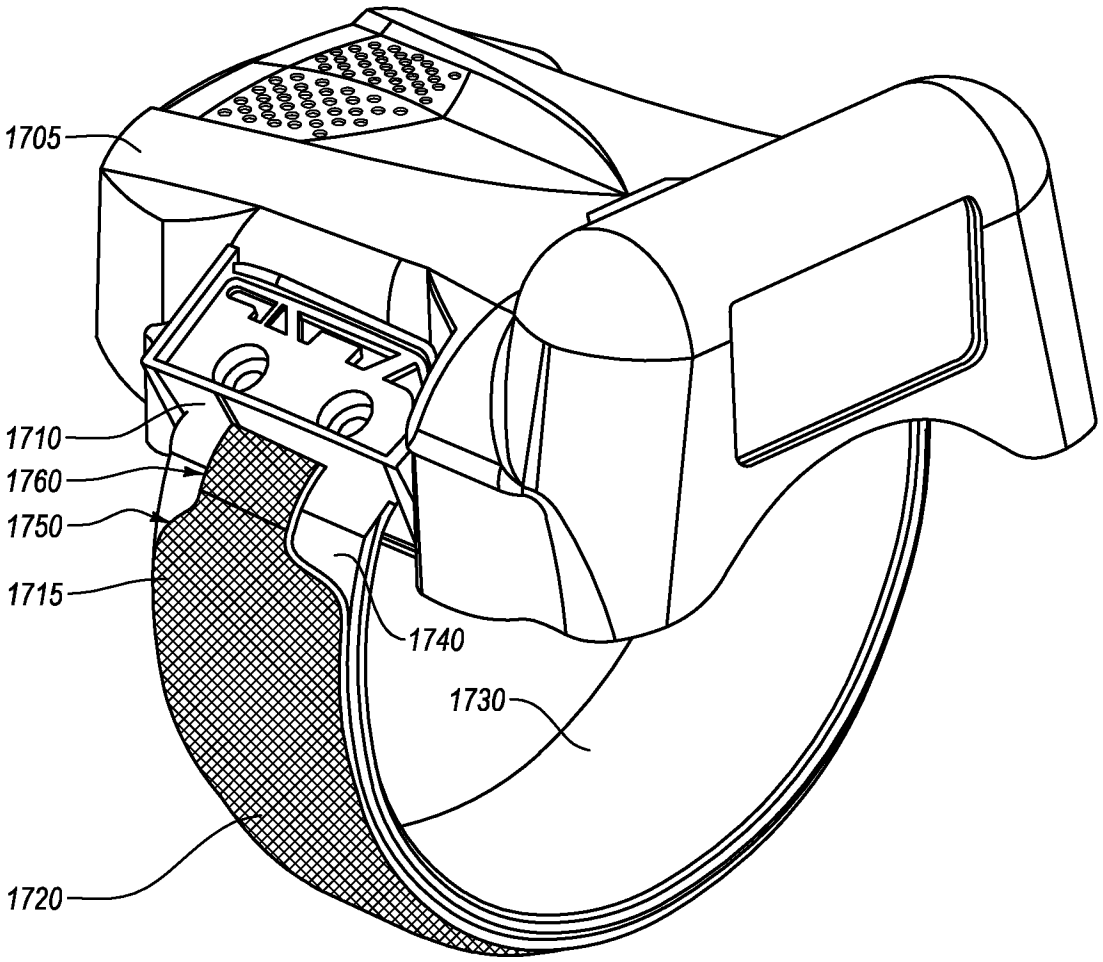
FIG. 17 illustrates a perspective view of a tracking device similar to FIG. 6, in which the secondary support strap has a tapered and narrow neck.

FIG. 17 illustrates one embodiment of a tracking device with a cuff or strap assembly 1730 that has been reinforced with a hardened band and that can also be equipped with the cut resistant materials described above. The cuff of this tracking device is similar to the cuff of the tracking device shown in FIG. 6. However, the hardened band 1720 of this configuration has been modified to further facilitate assembly and mounting of the cuff 1730 to the housing 1705.

As illustrated, the hardened band 1720 includes a tapered portion 1750 and a neck portion 1760 that has a width that is narrower than the rest of the hardened band 1720.

In one embodiment the hardened band is positioned on an outer side of the primary strap (as shown). In another embodiment, the hardened band is positioned inside of the primary strap, as mentioned above with regard to FIG. 6. In other embodiments, the hardened band 1720 is paired with another similar band (not shown), with the primary strap positioned there between (similar to the configuration of FIGS. 8*a* and 12).

While embodiments of the invention show a cuff/strap mounting to the tracking device housing with fasteners. It will be appreciated that in some embodiments, the cuff/strap is integrally formed with the housing, such as through a one-step, two-step or multiple-step molding process, or through a subsequent welding process.

The present invention may be embodied in other specific forms without departing from its spirit or essential characteristics. The described embodiments are to be considered in all respects only as illustrative and not restrictive. Accordingly, the scope of the invention extends to any combination of the features and elements that have been described herein. All changes which come within the meaning and range of equivalency of the claims are to be embraced within their scope.

What is claimed is:

1. A tracking device comprising:

a housing containing circuitry for detecting and communicating a location of the tracking device;

a mounting strap that is connected to the housing and that is configured in size and shape for being securely wrapped around and mounted to a part of a person wearing the tracking device;

a first hardened metal band that is affixed to a first side of the mounting strap and which provides reinforcing support to the mounting strap; and a cut-resistant material that is configured to at least resist cutting by a saw, the cut-resistant material being positioned directly against the first hardened band.

2. The tracking device of claim 1, wherein the mounting strap has an inner side and an outer side relative to the person wearing the mounting strap, the inner side comprising the first side of the mounting strap, the cut-resistant material being positioned on the outer side relative to the first hardened band.

3. The tracking device of claim 1, wherein the cut-resistant material comprises a woven material.

4. The tracking device of claim 1, wherein the cut-resistant material comprises a knitted material.

5. The tracking device of claim 1, wherein the cut-resistant material comprises a grouping of loose fiber strands.

6. The tracking device of claim 1, wherein the cut-resistant material comprises a fiber mesh.

7. The tracking device of claim 1, wherein the cut-resistant material comprises a plurality of sheets of material that are stacked or otherwise layered.

8. The tracking device of claim 1, wherein the cut-resistant material is formed into a tube or sleeve configuration.

9. The tracking device of claim 8, wherein the first hardened band is a metallic band.

10. The tracking device of claim 1, wherein the cut-resistant material is a high-density polyethylene fiber material.

11. The tracking device of claim 1, wherein the cut-resistant material is a basalt fiber material.

12. The tracking device of claim 1, wherein the cut-resistant material is a fiberglass material.

13. The tracking device of claim 1, wherein the cut-resistant material is a non-metallic synthetic material.

14. The tracking device of claim 1, wherein the tracking device further comprises a continuity cable that extends along the entire length of the mounting strap and that at least periodically carries a signal through the mounting strap to and from the circuitry in the housing, the cut-resistant material being positioned between the continuity cable and the first hardened band.

15. The tracking device recited in claim 14, wherein the continuity cable comprises at least one strand of an optical fiber and wherein the signal is an optical signal.

16. The tracking device recited in claim 1, the tracking device further comprising at least two different layers of the cut-resistant material, each of the at least two different layers comprising a different type of the cut-resistant material.

17. A tracking device comprising:

a housing;

tracking and monitoring circuitry for detecting a location of the tracking device;

communication circuitry for wirelessly communicating the location of the tracking device to a remote monitoring system, the tracking and monitoring circuitry and the communication circuitry being connected to the housing;

a primary mounting strap that is connected to the housing and that is configured in size and shape for being wrapped around an ankle of a person and for securely mounting the tracking device to the person;

at least one sub-strap that is composed of a different material than the primary mounting strap, the at least one sub-strap being composed of a material that is harder to sever with a cutting instrument than a material of the primary mounting strap; and a layer of cut-resistant material comprising at least one of a woven material, a knitted material, a fiber-stranded material, a mesh material or stacked sheets.

18. The tracking device of claim 17, the tracking device further comprising at least two different layers of the cut-resistant material, each of the at least two different layers comprising a different type of the cut-resistant material.

19. A tracking device comprising:

a housing;

tracking and monitoring circuitry for detecting a location of the tracking device contained at least partially within the housing;

a cuff that is connected to the housing and that is configured in size and shape for being wrapped around an ankle of a person and for securely mounting the tracking device to the person; and loose fiber material contained within the cuff.

20. The tracking device of claim 19, wherein the cuff and housing are integrally connected.

* * * * *

UNITED STATES PATENT AND TRADEMARK OFFICE

CERTIFICATE OF CORRECTION

PATENT NO. : 9,129,504 B2
APPLICATION NO. : 14/307260
DATED : September 8, 2015
INVENTOR(S) : Oliphant et al.

It is certified that error appears in the above-identified patent and that said Letters Patent is hereby corrected as shown below:

Specification

Column 13
Line 41, change "components be assembled" to --components can be assembled--

Signed and Sealed this
Twenty-second Day of March, 2016

Michelle K. Lee

Michelle K. Lee
*Director of the United States Patent and Trademark Office*